US008506063B2

(12) United States Patent
Limb et al.

(10) Patent No.: US 8,506,063 B2
(45) Date of Patent: Aug. 13, 2013

(54) COORDINATION OF PRESSURE AND TEMPERATURE DURING INK PHASE CHANGE

(75) Inventors: Scott Limb, Palo Alto, CA (US); John S. Paschkewitz, San Carlos, CA (US); Eric J. Shrader, Belmont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 296 days.

(21) Appl. No.: 13/022,278

(22) Filed: Feb. 7, 2011

(65) Prior Publication Data

US 2012/0200621 A1 Aug. 9, 2012

(51) Int. Cl.
*B41J 2/175* (2006.01)

(52) U.S. Cl.
USPC ..... 347/88

(58) Field of Classification Search
CPC ..... B41J 2/17509; B41J 29/377
USPC ..... 347/6, 17, 18, 88
See application file for complete search history.

(56) References Cited

U.S. PATENT DOCUMENTS

| | | | |
|---|---|---|---|
| 3,636,605 | A | 1/1972 | Vitcha et al. |
| 4,126,868 | A | 11/1978 | Kimer |
| 4,318,437 | A | 3/1982 | Kemp |
| 4,380,770 | A | 4/1983 | Maruyama |
| 4,517,577 | A | 5/1985 | Miranda et al. |
| 4,593,292 | A | 6/1986 | Lewis |
| 4,682,644 | A | 7/1987 | Ueno |
| 4,751,528 | A | 6/1988 | Spehrley et al. |
| 4,814,786 | A | 3/1989 | Hoisington et al. |
| 4,905,752 | A | 3/1990 | Rama Prasad |
| 4,981,166 | A | 1/1991 | Brown et al. |
| 5,105,209 | A | 4/1992 | Koto et al. |
| 5,205,340 | A | 4/1993 | Brown et al. |
| 5,271,451 | A | 12/1993 | Chandley et al. |
| 5,276,468 | A | 1/1994 | Deur et al. |

(Continued)

FOREIGN PATENT DOCUMENTS

| | | |
|---|---|---|
| EP | 0390202 | 10/1990 |
| EP | 0571127 | 11/1993 |

(Continued)

OTHER PUBLICATIONS

Rafael Nariman, Steel Casting Design Considerations, Material Matters, Fall 2004.

(Continued)

*Primary Examiner* — An Do
(74) *Attorney, Agent, or Firm* — Hollingsworth Davis, LLC

(57) ABSTRACT

A print head assembly for an ink jet printer includes an ink flow path configured to allow passage of a phase-change ink. A pressure unit is fluidically coupled to the ink flow path to apply a pressure to the ink. The applied pressure is controlled by a control unit during a time that the ink in the ink flow path is undergoing a phase change. During the phase change, a portion of the ink in a first region of the ink flow path is in liquid phase and another portion of the ink in another region of the ink flow path is in solid phase. A constant or variable pressure can be applied at least to the liquid phase portion of the ink during a phase transition from a liquid phase to a solid phase or from a solid phase to a liquid phase.

29 Claims, 29 Drawing Sheets

(56) References Cited

U.S. PATENT DOCUMENTS

| | | | | |
|---|---|---|---|---|
| 5,489,925 | A | 2/1996 | Brooks et al. | |
| 5,557,305 | A | 9/1996 | Hine et al. | |
| 5,621,444 | A | 4/1997 | Beeson | |
| 5,757,390 | A | 5/1998 | Bragg et al. | |
| 6,007,193 | A | 12/1999 | Kashimura et al. | |
| 6,176,573 | B1 | 1/2001 | Barth et al. | |
| 6,196,672 | B1 | 3/2001 | Ito et al. | |
| 6,257,715 | B1 | 7/2001 | Thielman et al. | |
| 6,334,671 | B1 | 1/2002 | Umehara | |
| 6,511,160 | B1 | 1/2003 | Morita et al. | |
| 6,530,658 | B1 | 3/2003 | Pham | |
| 6,905,201 | B2 | 6/2005 | Leighton | |
| 7,077,334 | B2 | 7/2006 | Sachs et al. | |
| 7,111,917 | B2 | 9/2006 | Hill et al. | |
| 7,121,658 | B2 | 10/2006 | Platt et al. | |
| 7,144,100 | B2 | 12/2006 | Hill et al. | |
| 7,188,941 | B2 | 3/2007 | Platt et al. | |
| 7,296,612 | B2 | 11/2007 | Bend | |
| 7,413,299 | B2 * | 8/2008 | Reeves | 347/88 |
| 7,416,286 | B2 | 8/2008 | Murata | |
| 7,682,008 | B2 | 3/2010 | Platt et al. | |
| 7,753,512 | B2 | 7/2010 | Jones et al. | |
| 7,815,281 | B2 | 10/2010 | Hayes et al. | |
| 8,052,264 | B2 | 11/2011 | Hayes et al. | |
| 8,070,277 | B2 | 12/2011 | Phillips et al. | |
| 8,096,648 | B2 * | 1/2012 | Jones | 347/88 |
| 2005/0007423 | A1 | 1/2005 | Iida et al. | |
| 2005/0062814 | A1 | 3/2005 | Yildirim et al. | |
| 2006/0209146 | A1 | 9/2006 | Reeves | |
| 2009/0231378 | A1 | 9/2009 | Snyder et al. | |
| 2009/0244172 | A1 | 10/2009 | Snyder | |
| 2009/0273658 | A1 | 11/2009 | Freitag et al. | |
| 2010/0194834 | A1 | 8/2010 | Jones | |

FOREIGN PATENT DOCUMENTS

| | | |
|---|---|---|
| EP | 1935651 | 6/2008 |
| EP | 2216177 | 8/2010 |
| WO | WO8805514 | 7/1988 |
| WO | WO2010077386 | 7/2010 |

OTHER PUBLICATIONS

European Search Report dated Jan. 31, 2012 from EP Application No. 11154464.9, 6 pages.
U.S. Appl. No. 12/714,031, filed Feb. 26, 2010, Paschkewitz et al.
U.S. Appl. No. 13/022,253, filed Feb. 7, 2011, Limb et al.
U.S. Appl. No. 13/022,264, filed Feb. 7, 2011, Limb.
U.S. Appl. No. 13/022,381, filed Feb. 7, 2011, Paschkewitz.
European Search Report and Written Opinion dated May 29, 2012 from EP Application No. 12153591.8, 6 pages.
European Search Report and Written Opinion dated May 30, 2012 from EP Application No. 12153580.1, 6 pages.
European Search Report and Written Opinion dated Jun. 1, 2012 from EP Application No. 12153589.2, 4 pages.
File history for U.S. Appl. No. 13/022,253.
File history for U.S. Appl. No. 13/022,264.
File history for U.S. Appl. No. 13/022,381.

* cited by examiner

COORDINATION OF PRESSURE AND TEMPERATURE DURING INK PHASE CHANGE

RELATED PATENT DOCUMENTS

This application is related to the following co-pending, concurrently filed U.S. Publication Nos. 2012/0200630, 2012/0200620, and 2012/0200631, each of which is incorporated by reference in its entirety.

FIELD

The present disclosure relates generally to methods and devices useful for ink jet printing.

SUMMARY

Embodiments described herein are directed to methods and devices used in ink jet printing. Some embodiments are directed to a print head assembly for an ink jet printer that includes an ink flow path configured to allow passage of a phase-change ink. A pressure unit can be fluidically coupled to the ink flow path to apply a pressure to the ink. A control unit is used to coordinate the pressure applied to the ink with temperature of the ink during a time that the ink in the ink flow path is undergoing a phase change. During the phase change, a portion of the ink in a first region of the ink flow path is in liquid phase and another portion of the ink in another region of the ink flow path is in solid phase. The pressure may be applied at least to portion of the ink in liquid phase during the time that the ink in the ink flow path is transitioning from a liquid phase to a solid phase or from a solid phase to a liquid phase. The pressure unit operating in conjunction with the control unit may apply a constant or variable pressure to the ink.

One or more active or passive thermal elements may be configured to heat or cool the ink. If active thermal units are used, the control unit may be used to control the thermal energy supplied to the ink by the active thermal units. The control unit can control the thermal elements to create a thermal gradient along at least a portion of the ink flow path during the time that the ink is undergoing the phase change. One or more temperature sensors may be positioned on components of the print head assembly that define the ink flow path. The temperature sensors generate electrical signals modulated by temperature of the ink. The control unit receives the electrical signals and controls the pressure applied to the ink in response to the electrical signals.

Some embodiments involve a method of operating an ink jet printer. Pressure is applied to ink in an ink flow path of an ink jet printer. The pressure is coordinated with ink temperature of during a time that the ink in the ink flow path is undergoing a phase change. During the ink phase change a first portion of the ink in a first region of the ink flow path is in liquid phase and a second portion of the ink in a second region of the ink flow path is in solid phase. Coordinating the pressure with temperature may involve controlling one or both of the applied pressure and the ink temperature. The temperature of the ink may be controlled to create or modify a a thermal gradient along at least a portion of the ink flow path during the time that the ink is undergoing the phase change.

Some embodiments involve a print head assembly. The print head assembly includes a print head having ink jets configured to selectively eject ink toward a print medium according to predetermined pattern. An ink flow path is defined by components of the print head assembly and is configured to allow passage of a phase-change ink along the ink flow path to the ink jets. The print head assembly also includes a pressure unit configured apply pressure to the ink. A control unit controls the pressure applied to the ink and coordinates the pressure applied to the ink with temperature of the ink during a time that the ink in the ink flow path is undergoing a phase change.

Some embodiments involve an ink jet printer that includes the print head assembly as describe above and a transport mechanism. The transport mechanism provides relative movement between the print medium and the print head.

The ink jet printer may include thermal elements configured to create and/or modify a thermal gradient along at least a portion of the ink flow path during the time that the ink is undergoing the phase change. One or more temperatures sensors can be used to sense the temperature of the ink at one or more locations. The sensed temperature can be used by the control unit to control the thermal elements to create and/or modify the thermal gradient based on the sensed temperature of the ink.

Some embodiments include a method of reducing voids in the ink of an ink jet printer. The temperature of ink in an ink flow path of the ink jet printer is determined during a time the ink is undergoing a transition from a liquid phase to a solid phase. Pressure applied to the ink is coordinated with the ink temperature during the transition. Coordinating the pressure comprises coordinating a variable pressure as a function of the temperature. One or more thermal elements may be controlled to create and/or modify a thermal gradient in the ink during the transition. The pressure can be coordinated with the thermal gradient. For example, the thermal elements may be controlled to apply phased zoned heating to the ink flow path. The phased zoned heating involves heating a first zone of the ink flow path and after heating the first zone, heating a second zone of the ink flow path to create a thermal gradient. The methods described above are useful for implementation in a phase change ink jet printer.

The above summary is not intended to describe each embodiment or every implementation. A more complete understanding will become apparent and appreciated by referring to the following detailed description and claims in conjunction with the accompanying drawings.

DESCRIPTION OF VARIOUS EMBODIMENTS

Figure 1:
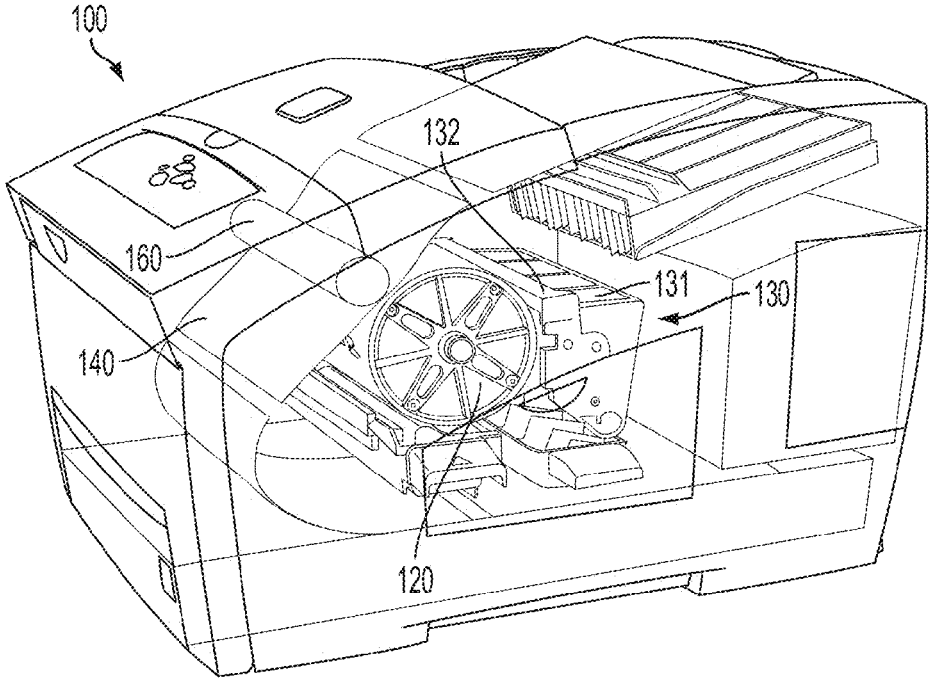
FIGS. 1 and 2 provide internal views of portions of an ink jet printer that incorporates void and bubble reduction features.

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature advantageously allow the ink to be transported and loaded into the ink jet printer in solid form, without the packaging or cartridges typically used for liquid inks In some implementations, the solid ink is melted in a page-width print head which jets the molten ink in a page-width pattern onto an intermediate drum. The pattern on the intermediate drum is transferred onto paper through a pressure nip.

In the liquid state, ink may contain bubbles and/or particles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink.

Embodiments described in this disclosure involve approaches for reducing voids and/or bubbles in phase-change ink. Approaches for bubble/void reduction may involve a thermal gradient that is present along an ink flow path of an ink jet printer during a time that the ink is undergoing a phase change. One or more components of a printer can be fluidically coupled to form the ink flow path. For example, in some cases, the components include an ink reservoir, a print head, including multiple ink jets, and manifolds fluidically coupled to form the ink flow path. A thermal gradient is present along the ink flow path during a time that the ink is undergoing a phase change. The thermal gradient causes one portion of the ink at a first location of the ink flow path to be in liquid phase while another portion of the ink at a second location of the ink flow path is in solid phase. The thermal gradient allows the liquid ink to move along the ink flow path to fill in voids and/or to push out air pockets in the portion of the ink that is still solid. By this approach, voids and bubbles in the ink are reduced. In some cases, the thermal gradient is present a time that the ink is transitioning from a solid phase to a liquid phase, for example, when the printer is first starting up. In some cases, the thermal gradient is present during a time that the ink is transitioning from a liquid phase to a solid phase, for example, when the printer is powering down.

Some embodiments involve the application of pressure to the ink in the ink flow path during a time that the ink is changing phase and a first portion of the ink is in solid phase while a second portion of the ink is in liquid phase. The ink may be transitioning from a solid phase to a liquid phase or to a liquid phase to a solid phase. The applied pressure may be continuous or pulsed and may be applied in conjunction with the creation of a thermal gradient along the ink flow path.

Some embodiments involve reducing voids and/or bubbles in phase change ink by coordinating the application of pressure with the temperature of the ink in the ink flow path. In some cases, the applied pressure can serve to push the liquid ink into voids, and push air bubbles towards the ink jet orifices or vents. The pressure may be applied from a pressure source, e.g., pressurized air or ink, and can be applied at one or more points along the ink flow path. In some cases, coordination of the pressure with temperature involves applying pressure in response to the ink reaching a predetermined temperature value. In some implementations, the application of pressure can be coordinated with creating and/or maintaining a thermal gradient along the ink flow path. The pressure can be continuous or variable and/or the amount of the applied pressure can be a function of temperature and/or temperature gradient. In some implementations, the pressure can be applied in multiple pressure pulses during a phase transition of the ink in the ink flow path.

Some embodiments involve approaches to reduce voids and bubbles in ink by designing and configuring a print head assembly to achieve a certain ratio of cooling rate to thermal gradient. The cooling rate to thermal gradient ratio may be controlled using passive or active thermal elements. The thermal elements can be used to facilitate a directional freeze or melt of the ink that provides reduces voids and bubbles. In some cases, pressure is applied to the ink in conjunction with the thermal elements that control the cooling rate/thermal gradient ratio.

Figure 2:
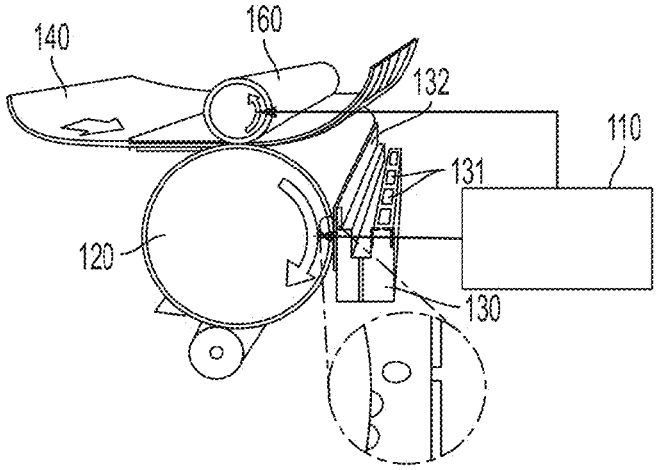

FIGS. 1 and 2 provide internal views of portions of an ink jet printer 100 that incorporates void and bubble reduction approaches as discussed herein. The printer 100 includes a transport mechanism 110 that is configured to move the drum 120 relative to the print head assembly 130 and to move the paper 140 relative to the drum 120. The print head assembly 130 may extend fully or partially along the length of the drum 120 and may include, for example, one or more ink reservoirs 131, e.g., a reservoir for each color, and a print head 132 that includes a number of ink jets. As the drum 120 is rotated by the transport mechanism 110, ink jets of the print head 132 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
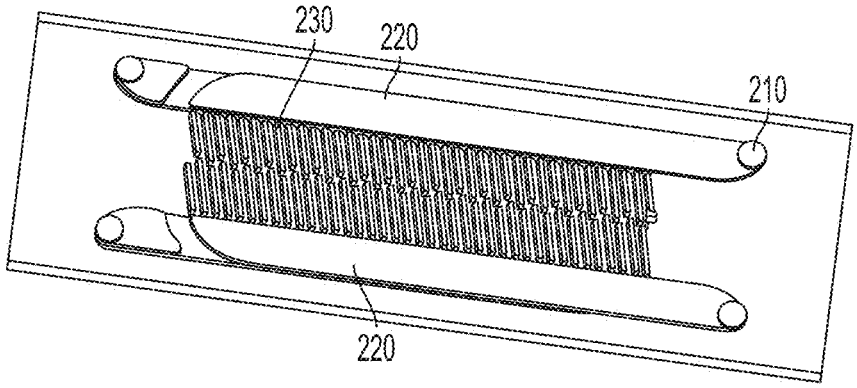
FIGS. 3 and 4 show views of an exemplary print head.
Figure 4:
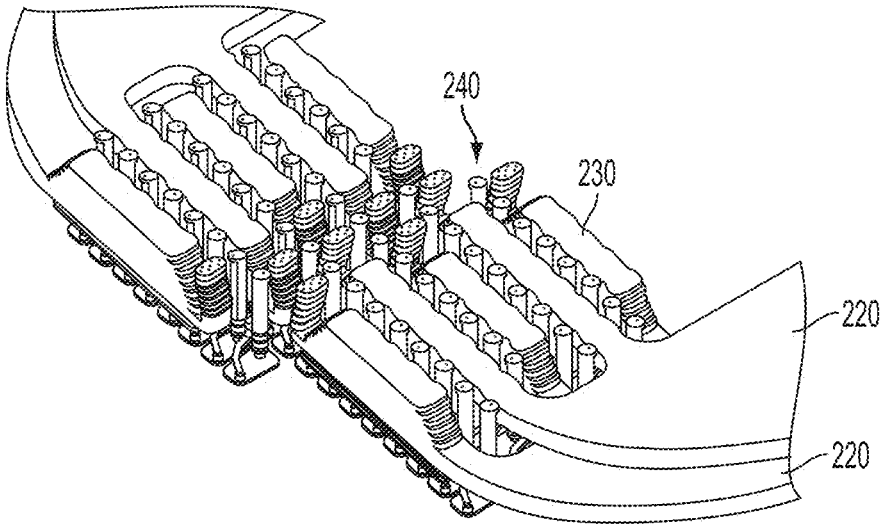

FIGS. 3 and 4 show more detailed views of an exemplary print head assembly. The path of molten ink, contained initially in the reservoir 131 (FIG. 2), flows through a port 210 into a main manifold 220 of the print head. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum. In some cases, the print head uses piezoelectric transducers (PZTs) for ink droplet ejection, although other methods of ink droplet ejection are known and such printers may also use the void and bubble reduction approaches described herein.

Figure 5:
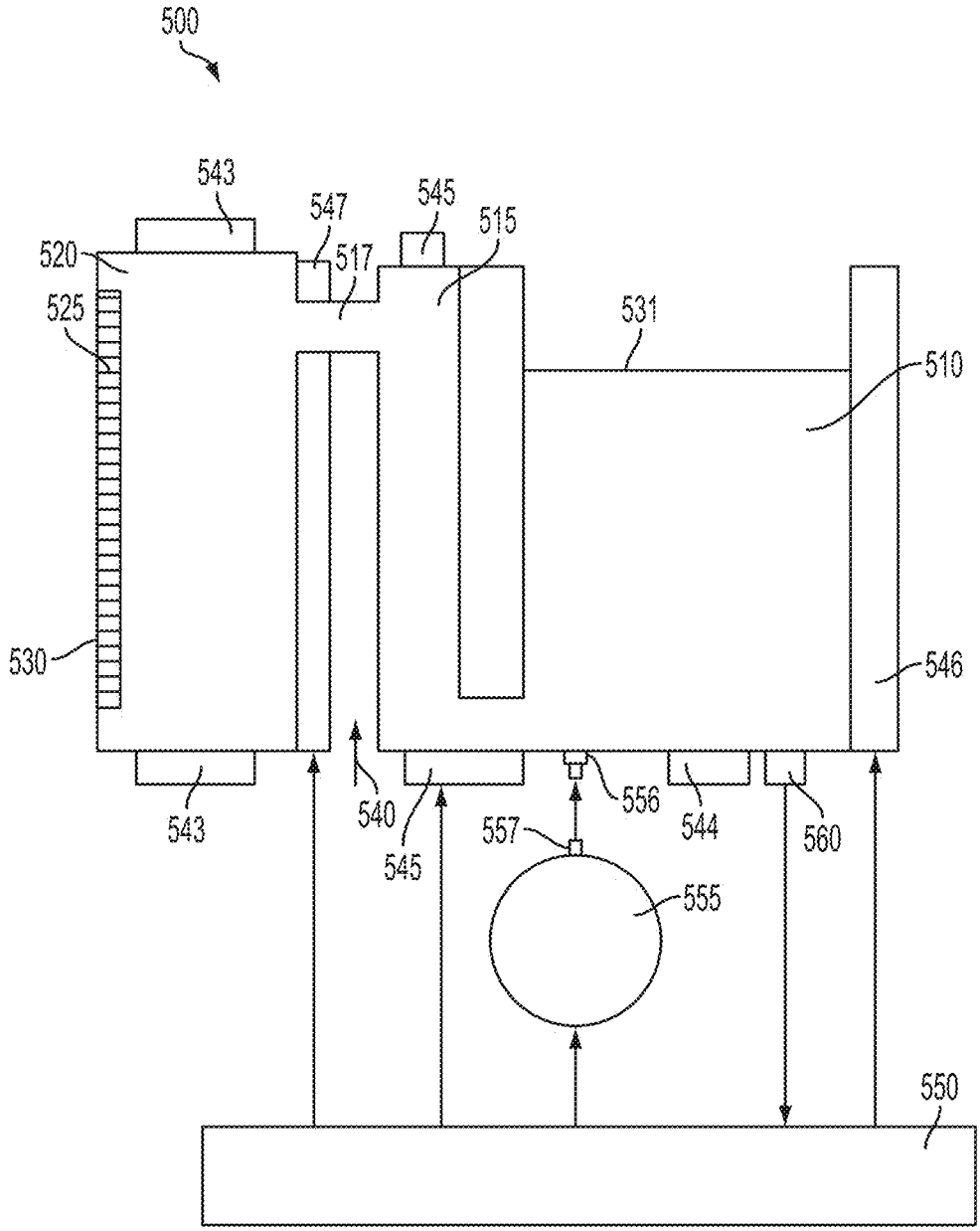
FIG. 5 is a diagram that illustrates a print head assembly that incorporates approaches for reducing voids and bubbles in the ink flow path.

FIG. 5 is a cross sectional view of an exemplary print head assembly 500 that illustrates some of the void and bubble reduction approaches discussed herein. The print head assembly 500 includes an ink reservoir 510 configured to contain a phase-change ink. The reservoir is fluidically coupled to a print head 520 that includes a jet stack. The jet stack may include manifolds and ink jets as previously discussed. In the print head assembly 500 illustrated in FIG. 5, the ink flow path is the fluidic path of the ink that is defined by various components of the print head assembly 500, such as the reservoir 510, siphon 515, print head inlet passage 517 and print head 520. The print head includes a jet stack 525 and the ink flow path within the print head 520 includes the jet stack 525, e.g., main manifolds, finger manifolds, and ink jets as illustrated in FIGS. 3 and 4. The ink flow path traverses the reservoir 510, through the siphon 515, through the print head inlet passage 517, through print head 520, through the jet stack 525, to the free surface 530 of the print head. The print head assembly 500 has two free surfaces 530, 531. One free surface 531 is at the input side of the ink flow path, at the reservoir 510. Another free surface 530 is at the output side of the ink flow path at the vents and/or jet orifices of the jet stack 525. One or more fluidic structures that form the ink flow path in the print head assembly 500 may be separated from one another by an air gap 540 or other insulator to achieve some amount of thermal decoupling between the fluidic structures.

The print head assembly 500 includes one or more thermal elements 543-547 that are configured to heat and/or cool the ink along the ink flow path. As depicted in FIG. 5, a first thermal element 546 may be positioned on or near the reservoir 510 and a second thermal element 547 may be positioned on or near the print head 520. The thermal elements 543-547 may be active thermal elements 546, 547, e.g., units that actively add heat or actively cool the ink flow path, and/or may be passive thermal elements 543-545, e.g., passive heat sinks, passive heat pipes, etc. In some implementations, the thermal elements 543-547 may be activated, deactivated, and/or otherwise controlled by a control unit 550. The control unit may comprise, for example, a microprocessor-based circuit unit and/or a programmable logic array circuit or other circuit elements. The control unit 550 may be integrated into the printer control unit or may be a stand alone unit. In some implementations, the control unit 550 may comprise a control unit configured to control temperature and pressure applied to the ink flow path during a bubble mitigation operation of the print head assembly. Bubble mitigation may occur at start up, shut down, or at any other time during operation of the printer.

In the case of active thermal elements 546, 547, the control unit 550 can activate and/or deactivate the active thermal elements 546, 547 and/or the control unit 550 may otherwise modify the energy output of the active thermal elements 546, 547 to achieve the desired set point temperature. The active thermal elements actively provide thermal energy into the system and may be cooling elements or heating elements. Active cooling may be achieved, for example, by controlling the flow of a coolant, e.g., gas or liquid and/or through the use of piezoelectric coolers. Active heating may be achieved by resistive or inductive heating. In the case of some passive thermal elements 545, the control unit 550 may activate, deactivate and/or otherwise control the passive thermal elements 545. For example, control of passive thermal elements 545 may be accomplished by the control unit 550 by generating signals that deploy or retract heat sink fins. In some implementations, the print head assembly 500 may also include one or more thermal elements 543, 544 that are not controlled by the control unit 550. The print head may be insulated by one or more insulating thermal elements 543, for example.

Optionally, the print head assembly 500 may include one or more temperature sensors 560 positioned along the ink flow path or elsewhere on the print head assembly 500. The temperature sensors 560 are capable of sensing temperature of the ink (or components 510, 515, 517, 529, 525 that form the ink flow path) and generating electrical signals modulated by the sensed temperature. In some cases, the control unit 550 uses the sensor signals to generate feedback signals to the thermal units 545-547 to control the operation of the thermal units 545-547.

Optionally, the print head assembly 500 includes a pressure unit 555 configured to apply pressure to the ink at one or more positions along the ink flow path. The pressure unit 555 may include at least one pressure source, one or more input ports 556 coupled to access the ink flow path, and one or more valves 557 that can be used to control the pressure applied to the ink flow path. The pressure source may comprise compressed air or compressed ink, for example. The pressure unit 555 may be controllable by the control unit 550. In some implementations, the control unit 550 may generate feedback signals to control the pressure unit based on the temperature sensor signals and/or sensed pressure signals.

Some approaches to void and bubble reduction involve creation of a thermal gradient along the ink flow path during a time that the ink is changing phase. The ink may be changing phase from a liquid phase to a solid phase, or to a solid phase to a liquid phase. When ink transitions from liquid to solid phase, the ink contracts, leaving voids in the solid phase ink. These voids may eventually be filled with air, which form air bubbles in the ink when the ink transitions from solid to liquid phase. As the ink is changing phase in the presence of the thermal gradient, a first portion of the ink in a first region of ink flow path may be in liquid phase while a second portion of the ink in a second region of the ink flow path is in solid phase.

A thermal gradient along the ink flow path when the ink is changing phase from liquid to solid may be created to reduce the number of voids that form while the ink is freezing. Keeping a first portion of the ink solid in a first region, e.g., near the print head, and another portion of the ink liquid in a second region, e.g., near the reservoir, allows liquid ink from the reservoir region to flow into the portion of the ink near the freeze front to reduce the number of voids that are formed during the phase transition.

A thermal gradient along the ink flow path when the ink is changing phase from a solid to a liquid may be used, e.g., during a purge process, to eliminate air present in the frozen ink, Voids in ink form during freezing when pockets of liquid ink are entrained by frozen ink. As the pockets of liquid ink freeze, the ink contracts forming a void. Voids can be filled with air through microchannels in the ink that connect the voids to a free surface of the print head assembly. A thermal gradient can be created in the ink flow path during the time that the ink is changing phase from solid to liquid. The thermal gradient may be such that the ink in and near the reservoir is liquid while the ink nearer the print head is solid. The thermal gradient allows liquid ink from the liquid phase ink nearer the reservoir to flow into air pockets in the solid phase ink, pushing the air out of the frozen ink through microchannels that lead to one of the free surfaces of the print head assembly.

Figure 6:
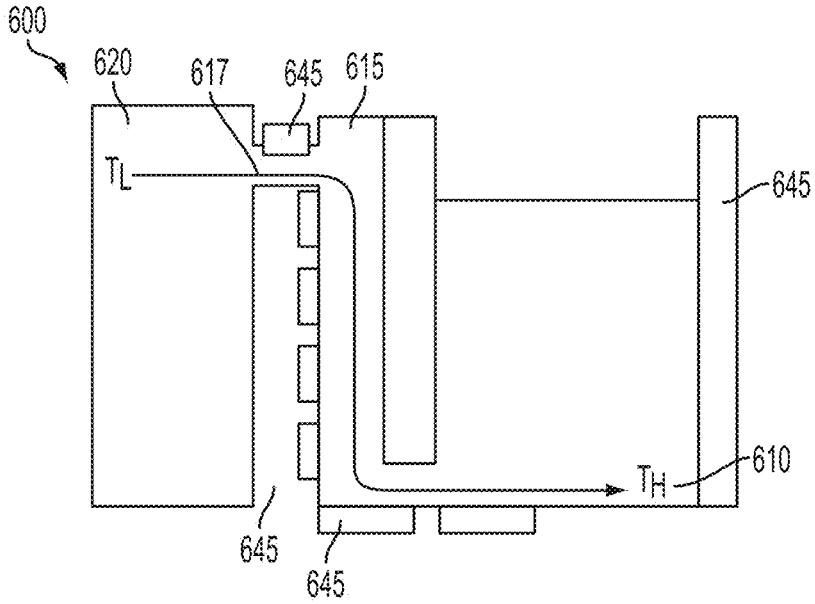
FIGS. 6 and 7 illustrate thermal gradients along an ink flow path.

FIG. 6 illustrates a print head assembly 600 that includes multiple thermal elements 645 that are controllable by a control unit (not shown) to create a thermal gradient in the print head assembly. As depicted in FIG. 6 the multiple thermal elements 645 may be positioned along portions of the ink flow path including the reservoir 610, siphon 615, and/or print head inlet 617. Alternatively or additionally, the thermal elements 645 may also be positioned in, on, or near the print head 620, including, for example, in, on, or near manifolds of the jet stack.

As illustrated by FIG. 6, multiple thermal elements 645 can be disposed along the ink flow path to enable zoned control of a thermal gradient created along the ink flow path. Zoned thermal control using multiple thermal elements 645 involves controlled heating or cooling of various regions of the ink flow path and allows more precise control of the thermal gradient along the ink flow path. In some cases, the thermal gradient is controlled to achieve a higher ink temperature, $T_H$, at or near the reservoir 610 and a lower ink temperature, $T_L$, at or near the print head 620 as indicated by the arrow of FIG. 6. In this scenario, the temperature of ink in or nearer to the reservoir 610 can be maintained above the ink melting point and thus the ink in this zone is liquid. The temperature of the ink in or nearer to the print head 620 is below the ink melting point and is frozen. Although FIG. 6 illustrates a thermal gradient that transitions from a higher temperature at the reservoir 610 to a lower temperature at the print head 620, in alternate implementations, the zoned thermal control may create a thermal gradient that transitions from a lower temperature at the reservoir to a higher temperature at the print head.

Figure 7:
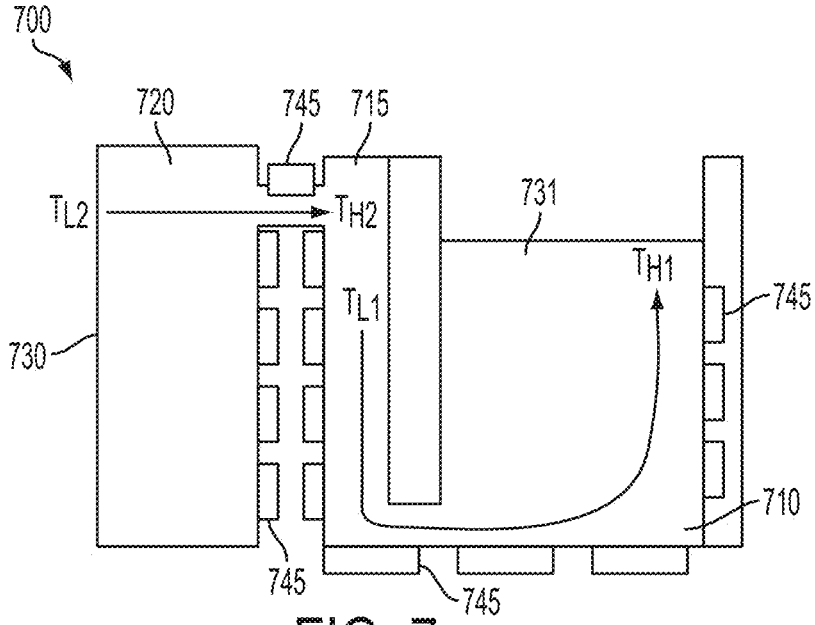

FIG. 7 illustrates multiple thermal elements 745 that may be used for zoned thermal control to create one more bifurcated thermal gradients. As depicted in FIG. 7, a first thermal gradient in a first region of the ink flow channel transitions from a higher temperature, $T_{H1}$, at a zone in the reservoir 710 to a lower temperature, $T_{L1}$, at a first zone in the siphon area 715. A second thermal gradient transitions from a higher temperature, $T_{H2}$, at a second zone in the siphon area 715 to a lower temperature, $T_{L2}$, near the free surface 730 of the print head 720. The second zone of the siphon 715 may be larger volume region connected to an air vent (not shown in FIG. 7). A bifurcated thermal gradient may be helpful to move liquid ink toward multiple the free surfaces of the print head assembly.

Some approaches of void and bubble reduction include application of pressure from a pressure source to the ink during a time that the ink is undergoing a phase change. The pressure source may be pressurized ink, air, or other substance, for example. The pressure can be applied at any point along the ink flow path and can be controlled by the control unit. In some cases, the control unit controls the application of pressure in coordination with the temperature of the ink. For example, the pressure can be applied when the ink is expected to be at a particular temperature, based on system thermodynamics, or when temperature sensors indicate that the ink at a particular location of the ink flow path reaches a predetermined temperature. In some cases, the amount and/or location of the pressure can be applied in coordination with a thermal gradient achieved, for example, by zoned heating or cooling of the ink flow path.

Figure 8:
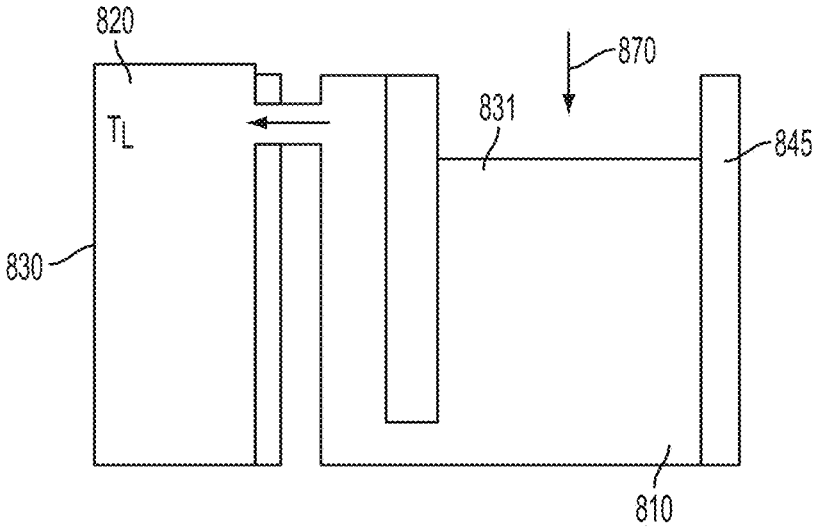
FIG. 8 is a diagram that illustrates pressure applied to the ink flow path at the reservoir.

FIG. 8 illustrates application of pressure 870 to the ink during a time that the ink is changing phase. For example, in some cases, only the reservoir heater(s) 845 are activated to bring the ink in the reservoir 810 to a temperature beyond the melting temperature of the ink, e.g., in excess of 90 C. The reservoir heaters 845 are brought to a set point temperature that is sufficiently high to melt the ink in the reservoir 810, but the set point temperature is so high and/or is not maintained so long that the ink in the print head 820 also melts. A sufficient temperature differential between the ink in the reservoir 810 and the ink in the print head 820 is maintained to keep the ink in the print head 820 frozen while the ink in the reservoir 810 is liquid. For example, depending on the ink used and the geometry of the print head assembly, when the reservoir is 90 C, a temperature differential between the temperature of the of reservoir and the temperature of the print head in a range of about 5 C to about 15 C will keep the print head ink frozen while the reservoir ink is liquid. While the ink in the reservoir is liquid and the ink in the print head remains frozen, the pressure 870 is applied, e.g., at the reservoir free surface 831. The pressure 870 facilitates movement of the liquid ink from the reservoir 810 into voids and air pockets in the frozen ink. The movement of liquid ink into the voids and air pockets eliminates the voids and causes air to be pushed out through the print head free surface 830 through microchannels (cracks) present in the frozen ink.

Figure 9:
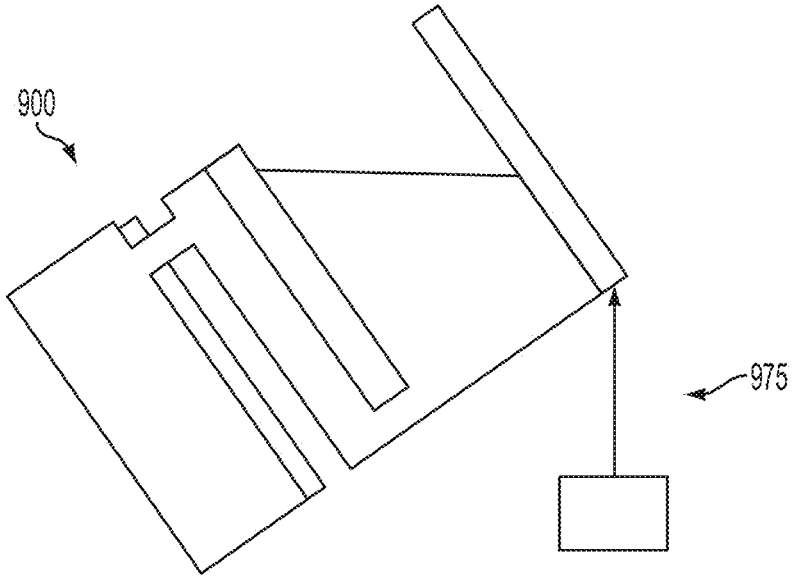
FIGS. 9 and 10 illustrate various approaches to passively apply pressure to the ink flow path.
Figure 10:
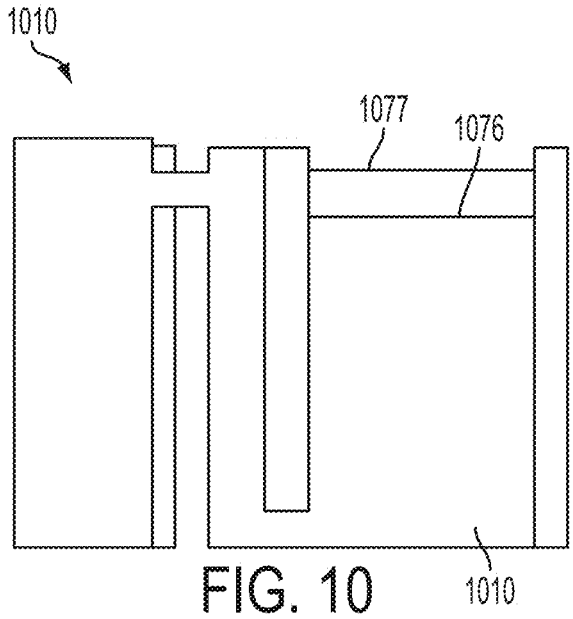

FIGS. 9 and 10 illustrate approaches to passively increase the pressure on the ink in the ink flow path. As depicted in FIG. 9, all or a portion of the ink flow path may be tilted to increase pressure on the ink. Components of the print head assembly 900 are tilted so that the entire ink flow path of the print head assembly 900 is tilted in FIG. 9. In other embodiments, only components that define a portion of the ink flow path may be tilted. The print head assembly 900 can include an orientation mechanism 975 configured to orient components of the print head assembly 900 to achieve the tilting. In some implementations, components of the print head assembly 900 may be oriented in one position during the ink phase change to increase pressure on the ink in the ink flow path. The components may be oriented in another position during other periods of time, e.g., during operation of the printer. In some cases, the print head orientation mechanism can be controlled by the control unit, e.g., based on temperature, pressure and/or thermal gradient of the ink flow path. Tilting of the reservoir 910 as illustrated in FIG. 9 may also be implemented to allow bubbles in the ink to rise to the free surface of the reservoir 910.

FIG. 10 depicts another example of a process to increase pressure on the ink. In this example, the reservoir 1010 is overfilled in excess of a previous or normal ink level 1076 which increases the pressure along the ink flow path of the print head assembly 1000. In some cases, the overfill ink 1077 may be added to the reservoir 1010 during the power up sequence for the printer. Alternatively, the overfill ink 1077 may be added to the reservoir 1010 during the power down sequence of the printer.

Figure 11:
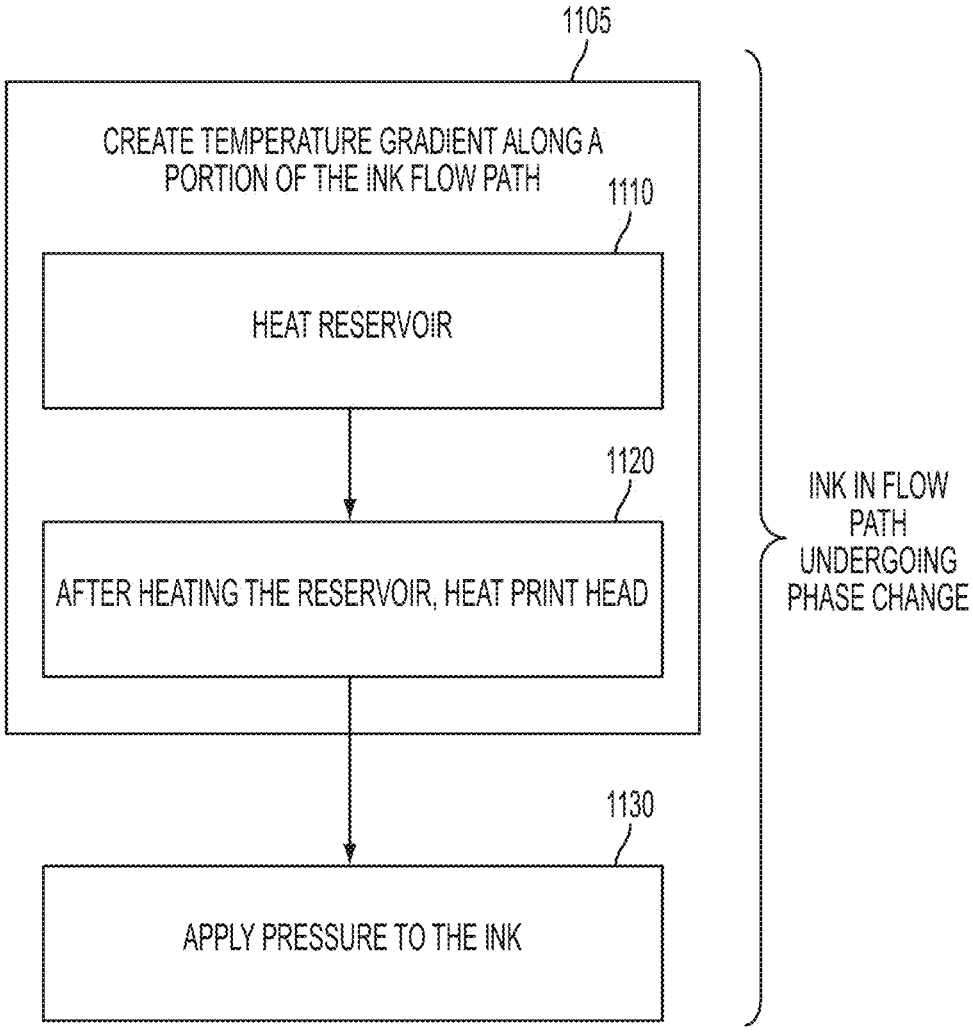
FIG. 11 is a flow diagram illustrating a process for reducing bubbles and voids in an ink flow path while the ink is undergoing a phase change.

As discussed above, the use of thermal gradients in the ink flow path, ink pressurization, and/or coordination between temperature, temperature gradients, and pressure for void and/or bubble reduction may be used when the ink is transitioning from the solid phase to the liquid phase, e.g., during the printer power up sequence. FIG. 11 is a flow diagram illustrating an exemplary process for void and/or bubble reduction during a time that the ink is transitioning from a solid phase to a liquid phase. The process illustrated in FIG. 11 may be used, for example, to purge the ink flow path of voids and/or bubbles as the printer is powering up. The reservoir and print head are heated 1110, 1120 in phased sequence. The reservoir is heated first to a temperature that melts the ink in the reservoir while the ink nearer to the print head is held at a temperature that keeps the ink frozen. The temperature gradient between the ink in the reservoir and the ink in the print head facilitates depressurization of the ink flow system through the system vents and ink jet orifices at the print head free surface. The thermal gradient created 1105 by heating the reservoir and print head in phased sequence provides a semi-controlled movement of ink into voids and reduction of bubbles. The rates of temperature rise of the reservoir and/or print head are controlled to achieve optimal void/bubble reduction. After the thermal gradient is created 1105 along the ink flow path, pressure may optionally be applied 1130 to the ink to further increase void and bubble reduction. For example, the application of pressure may be achieved by one or more active and passive pressurization techniques, such as those described herein.

Figure 12:
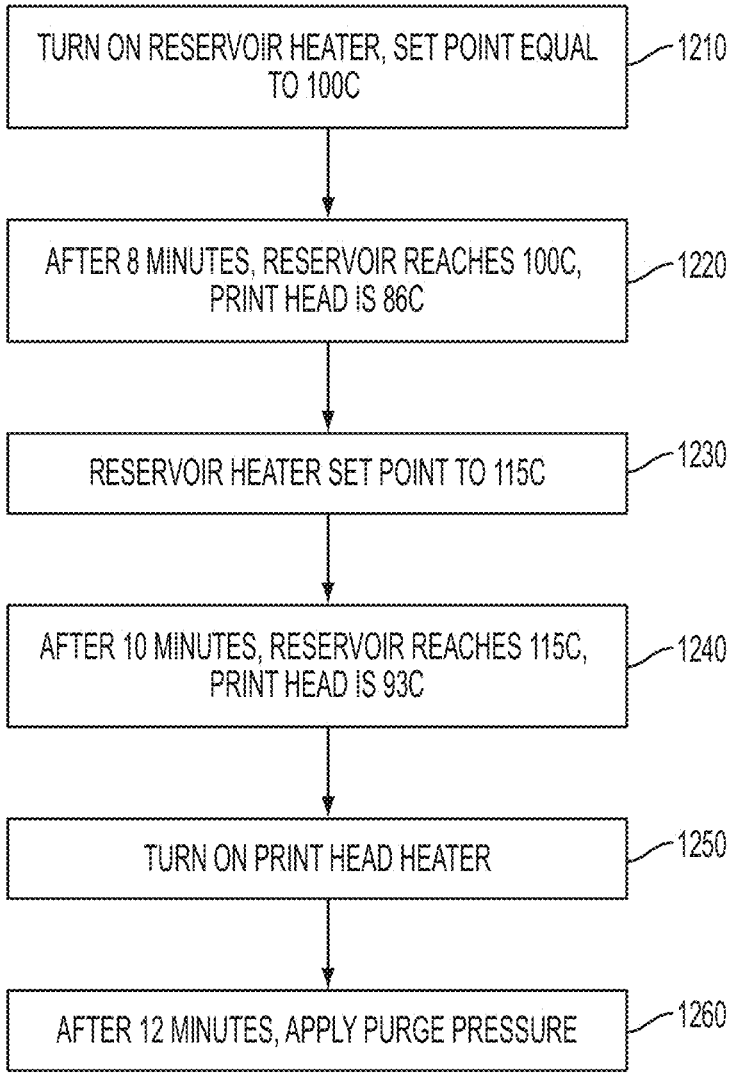
FIG. 12 is a flow diagram illustrating a process for reducing bubbles and voids in ink during an operation of the print head assembly in which the ink is transitioning from solid phase to liquid phase.
Figure 13:
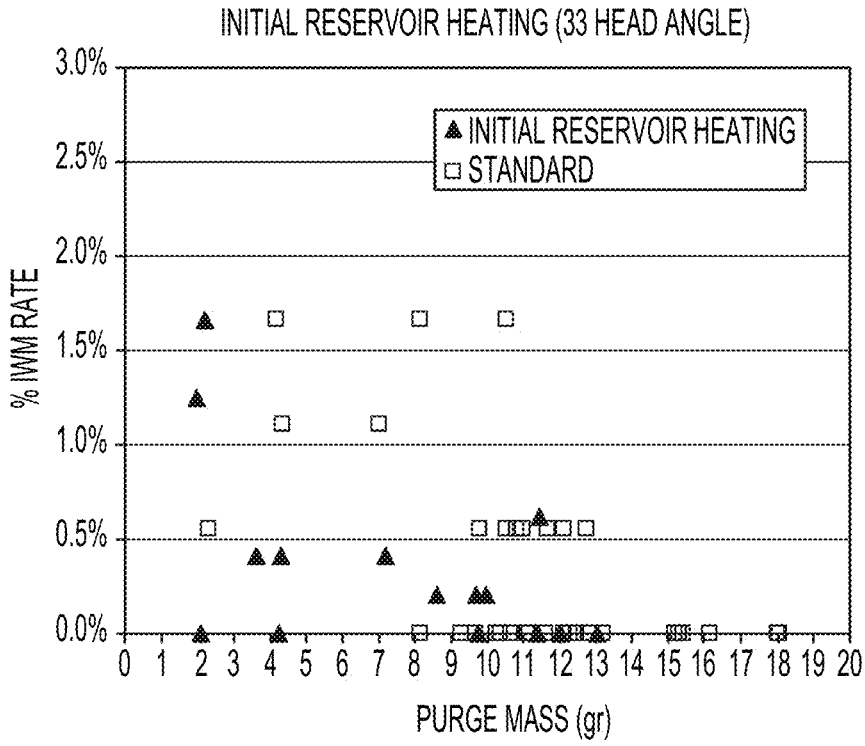
FIG. 13 is a graph comparing print quality following a bubble mitigation operation that included the presence of a thermal gradient that caused one portion of the ink to be in solid phase and another portion of the ink to be in liquid phase with a standard bubble mitigation without a thermal gradient.

A more detailed sequence for the above process is illustrated by the flow diagram of FIG. 12. The reservoir heaters are activated 1210 with a set point temperature of about 100 C. The reservoir reaches 100 C at about 8 minutes, and at this time the print head temperature is 1220 about 86 C. Next, the reservoir set point temperature is increased 1230 to about 115 C and this temperature is reached 1240 in the reservoir after about 10 minutes. At that time, the print head is at about 93 C. At this point, the print head heater is activated 1250. About 12 minutes after the print head heater is turned on, a purge pressure, e.g., about 4 to about 10 psig, is applied 1260 to the ink. Implementation of this process avoids ink dripping from the print head during the bubble mitigation operation. Before the print head heaters are turned on, small beads of ink wax appear at the ink jets and larger beads of ink wax bubble at the purge vents, indicating escaping gas. After the print head heaters are turned on, ink wax beads recede into the print head and the print head surfaces is clean. The process described in FIG. 12 is applicable to ink that is a mixture having a melting range, and is typically fully liquid at about 85 C. A thermal gradient greater than about 12 C keeps the ink at the print head frozen when the ink in the reservoir is liquid.

The thermal gradient created by the process described in connection with FIG. 12 allows voids/bubbles to be pushed out of the ink system. In contrast, when no thermal gradient is present, i.e., both the reservoir and print head are heated at about the same time to about the same temperature, air can be trapped in the fluidic coupling between the reservoir and the print head, e.g., in the siphon area of the print head assembly. When ink transitions from solid to liquid state, e.g., during start-up operations, some ink may be forced out of the print head. The ink is forced out of the print head due to pressure from ink expansion (approximately 18%) and gas expansion which increases the pressure on the ink due to the temperature rise from room temperature (20 C) to 115 C. Ink dripping from the print head, sometimes referred to as "drooling," is undesirable and wastes ink. Drooling typically does not effectively contribute to purging the print head of air and on multicolor print heads leads to cross-contamination of nozzles with different color ink.

In contrast, a controlled temperature increase that creates a thermal gradient along the ink flow path allows the voids and bubbles to be vented from the system with minimal ink seeping from the ink jets and print head vents. The processes illustrated in FIGS. 11 and 12 use microchannels formed in the solid phase ink to expel air bubbles. Pressurization from controlled ink flow and temperature increases serves to eliminate voids and to expel pockets of air through the print head, thus reducing bubbles present in the ink during print operations.

Bubbles in the ink are undesirable because they lead to printing defects which can include intermittent ink jetting, weak ink jetting and/or jets that fail to print from one or more ink jets of the print head. These undesirable printing defects are referred to herein ad intermittent, weak, or missing events (IWMs). Various implementations discussed herein are helpful to reduce the IWM rate due to bubbles in ink. The IWM rate is an indicator of the effectiveness of a bubble mitigation method. If bubbles are entrained into the ink jets, the jets will not fire properly giving an intermittent, weak or missing jet.

Figure 14:
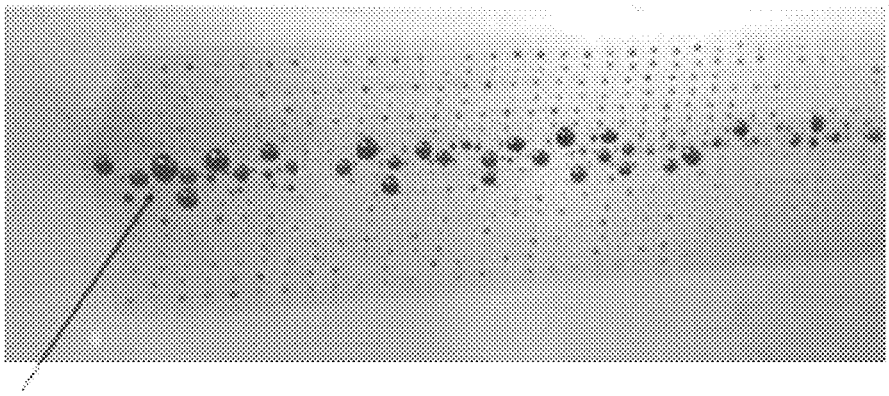
FIG. 14 is a photograph showing ink bulging from the ink jets and vents during a bubble mitigation process that includes the presence of the thermal gradient that causes the ink in the reservoir to be liquid while the ink at the print head remains solid.

The effectiveness of a bubble mitigation process that included creation of a thermal gradient by phased heating of the ink, as discussed in connection with FIG. 12, was compared to a standard bubble mitigation process in which ink in the reservoir and print head was heated simultaneously. For both the phased and simultaneous heating during bubble mitigation, the print head assembly was tilted at an angle of about 33 degrees. In these tests, the rate of intermittent, weak, or missing (IWM) printing events was determined as a function of ink mass exiting the ink jets during the bubble mitigation process. It is desirable to achieve both low exiting ink mass and low IWM rate. FIG. 14 compares the results of the tests. As can be appreciated from FIG. 14, in most cases, it is possible to achieve a desired IWM rate at a lower exiting ink mass using the phased heating bubble mitigation process depicted in FIG. 12 when compared to the standard simultaneous heating bubble mitigation process.

Figure 15:
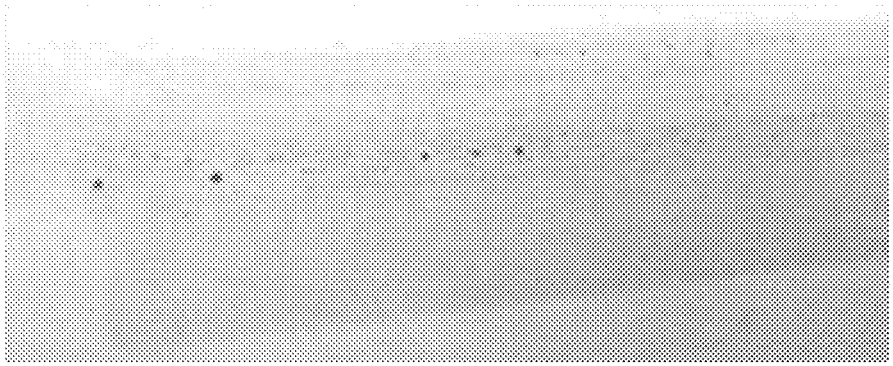
FIG. 15 is a photograph showing and the print head of FIG. 14 after the bubble mitigation process.
Figure 16:
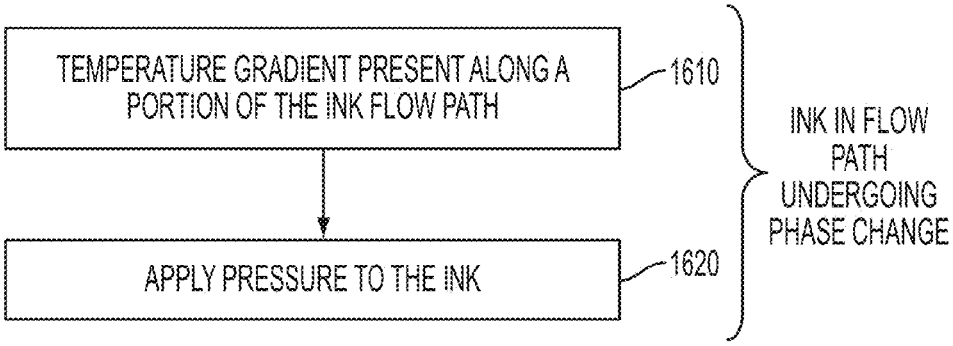
FIG. 16 is a flow diagram illustrating bubble and void reduction that involves application of pressure during a time that a thermal gradient is present in along the ink flow path, the thermal gradient causing a first portion of the ink to be in solid phase and a second portion of the ink to be in liquid phase.

The phased heating approach also avoids ink dripping from the print head during the start-up operation. As depicted in the photograph of FIG. 15, before the print head heaters are turned on, the print head ink is at 93 C. Small beads of ink appear at the ink jets and larger beads of ink wax bubble at the purge vents, indicating escaping gas. The photograph of FIG. 16 shows the print head after the print head heaters are turned on and the temperature of the ink in the print head rises to about 115 C. Ink beads recede into the print head and the print head surfaces is clean.

Some approaches involve applying pressure to the ink during a time that the ink is changing phase from a liquid to a solid. The flow diagram of FIG. 16 exemplifies this process. During a time that the ink is transitioning from a liquid to a solid phase, a thermal gradient exists 1610 along the ink flow path. For example, the thermal gradient may be such that ink in one region of the flow path is liquid while ink in another region of the flow path is solid. During the time that the ink is undergoing the phase change from liquid to solid, pressure is applied 1620 to the ink. The pressure serves to reduce voids in the ink that could become air bubbles when the ink melts.

Some approaches for void/bubble reduction involve coordination of temperature with applied pressure during a time that the ink is changing phase. The ink may be changing from solid phase to liquid phase or from liquid phase to solid phase. During the time that the ink is changing phase, a portion of the ink in a first region of the ink flow path is liquid while another portion of the ink in a second region of the ink flow path is solid. Pressurization of the liquid ink forces ink into the voids and pushes air bubbles out through channels in the frozen ink. Coordination of applied pressure with ink temperature may be implemented with or without the zone heating that creates a thermal gradient along the ink flow path.

Figure 17:
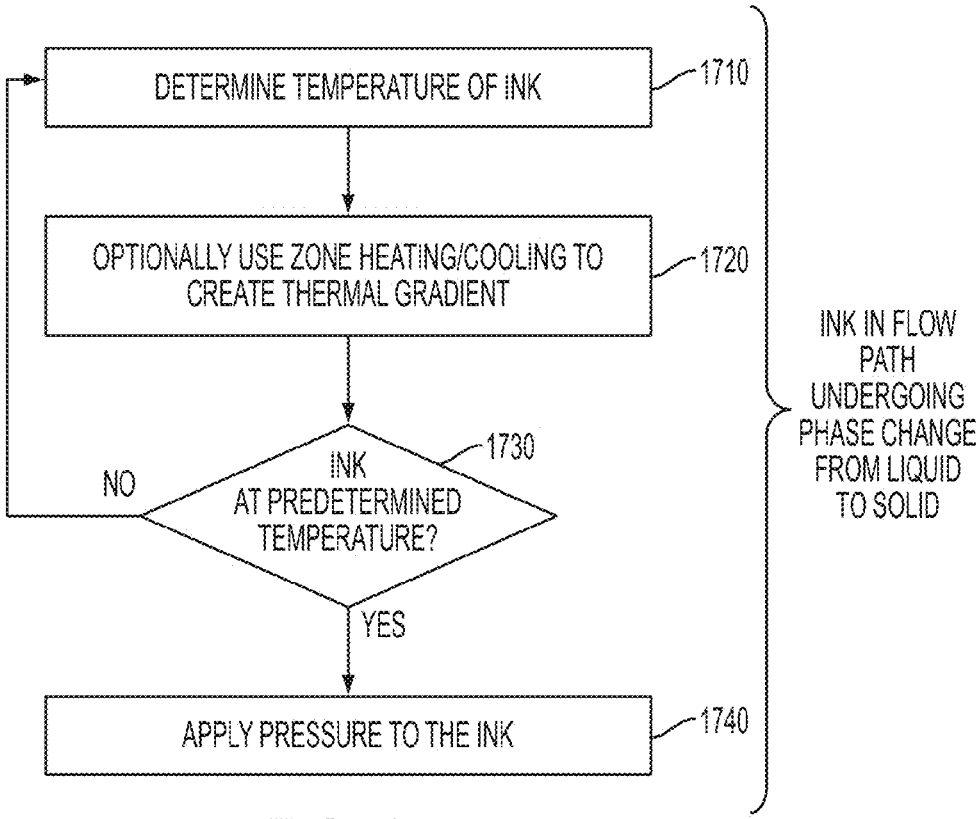
FIG. 17 is a flow diagram illustrating bubble and void reduction involving the presence of a thermal gradient along an ink flow path and coordination of the application of pressure with temperature.

The flow diagram of FIG. 17 illustrates a process for reducing voids/bubbles in the ink when the ink in the ink flow path is undergoing a phase change from a liquid phase to a solid phase, e.g., during a printer power-off sequence. The process relies on determining (or estimating) 1710 the temperature of the ink and applying pressure 1740 in coordination with the temperature. In some cases, the ink temperature is determined using temperature sensors disposed along the flow path to sense the temperature of the ink. In some cases, the temperature of the ink may be estimated knowing set point of the thermal element and the thermal response function of the print head assembly. Optionally, zone heating/cooling may be used to create and/or maintain 1720 a thermal gradient along the ink flow path. When the sensed ink temperature falls 1730 to a predetermined temperature, pressure is applied 1740 to the ink.

Figure 18:
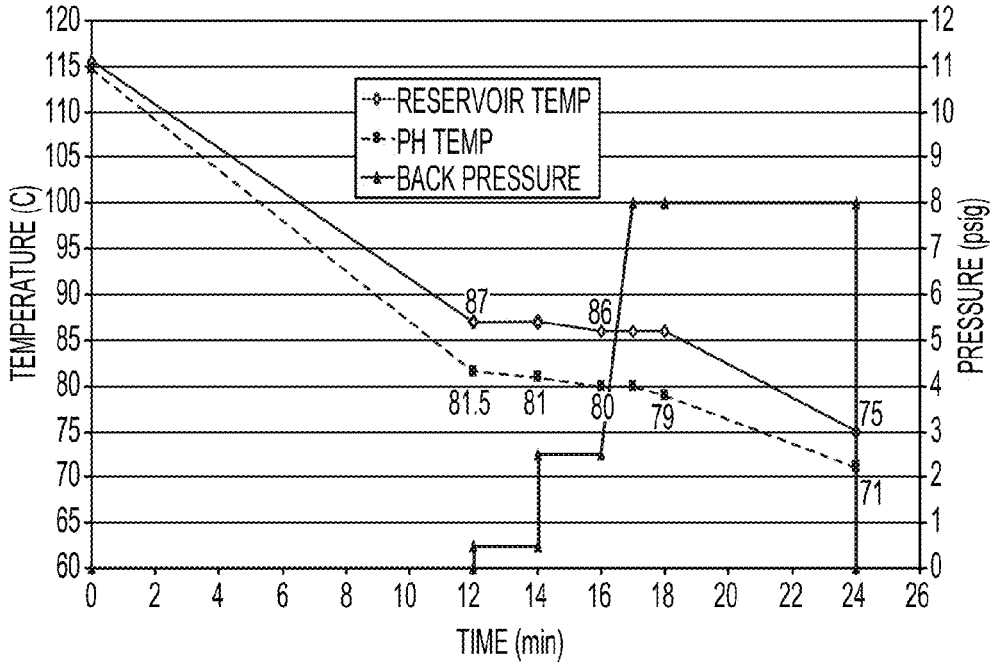
FIG. 18 illustrates coordination of pressure with temperature as the ink in an ink flow path transitions from liquid to solid phase.

In some implementations, a variable pressure is applied to the ink and the applied pressure is coordinated with the temperature of the ink and/or the thermal gradient of the ink flow path. FIG. 18 depicts three graphs including temperature of the reservoir, temperature of the print head, and pressure applied to the ink during a time that the ink is transitioning from a liquid phase to a solid phase. At time t=0, the ink temperature is 115 C at both the print head and the reservoir and the ink is liquid throughout the ink flow path. At time t=0, the print head heater set point is adjusted to 81.5 C, the reservoir heater set point is adjusted to a slightly higher temperature to create a thermal gradient in the ink flow path between the reservoir and the print head. As the ink cools, the difference in temperature between the ink in the reservoir and the ink in the print head increases until the set point temperatures of 87 C (reservoir) and 81.5 (print head) are reached at about 12 minutes. At about 12 minutes, a pressure of about 0.5 psi is applied to the ink at the reservoir. The pressure is increased as the temperatures of the print head and reservoir gradually decrease, while the thermal gradient between the print head and the reservoir is maintained. At about 16 minutes, the temperature of the reservoir is 86 C, the temperature of the print head is 80 C and the pressure is increased to 8 psi. The print head and reservoir heaters are turned off. The pressure is maintained at about 8 psi for about 8 minutes as the print head and reservoir continue to cool.

Figure 19:
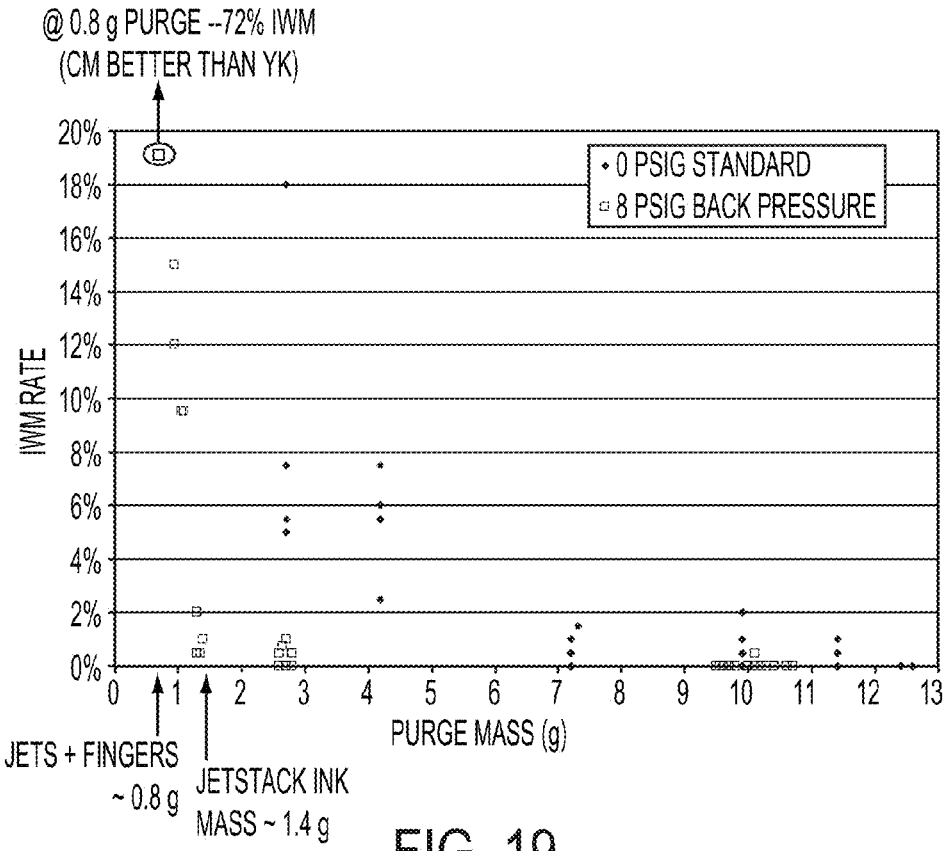
FIG. 19 compares print quality results achieved by applying pressure and coordinating the pressure with temperature during a time that the ink is transitioning from a liquid phase to a solid phase with print quality results achieved without the application of pressure.

Effectiveness of the process that included coordination of pressure and temperature as illustrated in FIG. 18 was compared with a standard cool down process that did not apply pressure to the ink or coordinate temperature with pressure while the ink was freezing. In these tests the mitigation of bubble formation, as determined by the rate of intermittent, weak, or missing (IWM) printing events, was determined as a function of exiting ink mass. It is desirable to achieve both low exiting ink mass and low IWM rate. FIG. 19 compares the results of the tests. As can be appreciated from FIG. 18, it is possible to achieve a desired IWM rate at a lower exiting ink mass (i.e., purge mass) by applying pressure to the ink during the bubble mitigation process. Note that the apparatus in this test included ink jets and finger manifolds that contain approximately 0.8 g of ink, and ink jet stack that contains approximately 1.4 grams of ink. For the test that used applied pressure during cool down, the rate of IWMs dropped from about 19% to less than 2% after a purge mass of approximately 1.2 grams. There were no groups of 8 missing jets after a 1.4 gram purge. This test illustrates the effectiveness of the pressurized freezing procedure in mitigating bubbles in the siphon region as the amount of ink exiting is equivalent to the volume of the jet stack. Since only the ink in the jet stack is purged, this means the ink from the siphons is used for the IWM printing tests. Entrainment of bubbles from the siphons will cause IWM events. Since none are observed, this is evidence that the siphons are substantially bubble-free.

The temperature/thermal gradient/pressure profile for the print head assembly cool down illustrated by FIG. 18 is one illustration of coordination of pressure with temperature and/or thermal gradient of the print head assembly. Other pressure, temperature, and thermal gradient values can be selected according the print head assembly properties in other coordinated processes of temperature and pressure.

Figure 20:
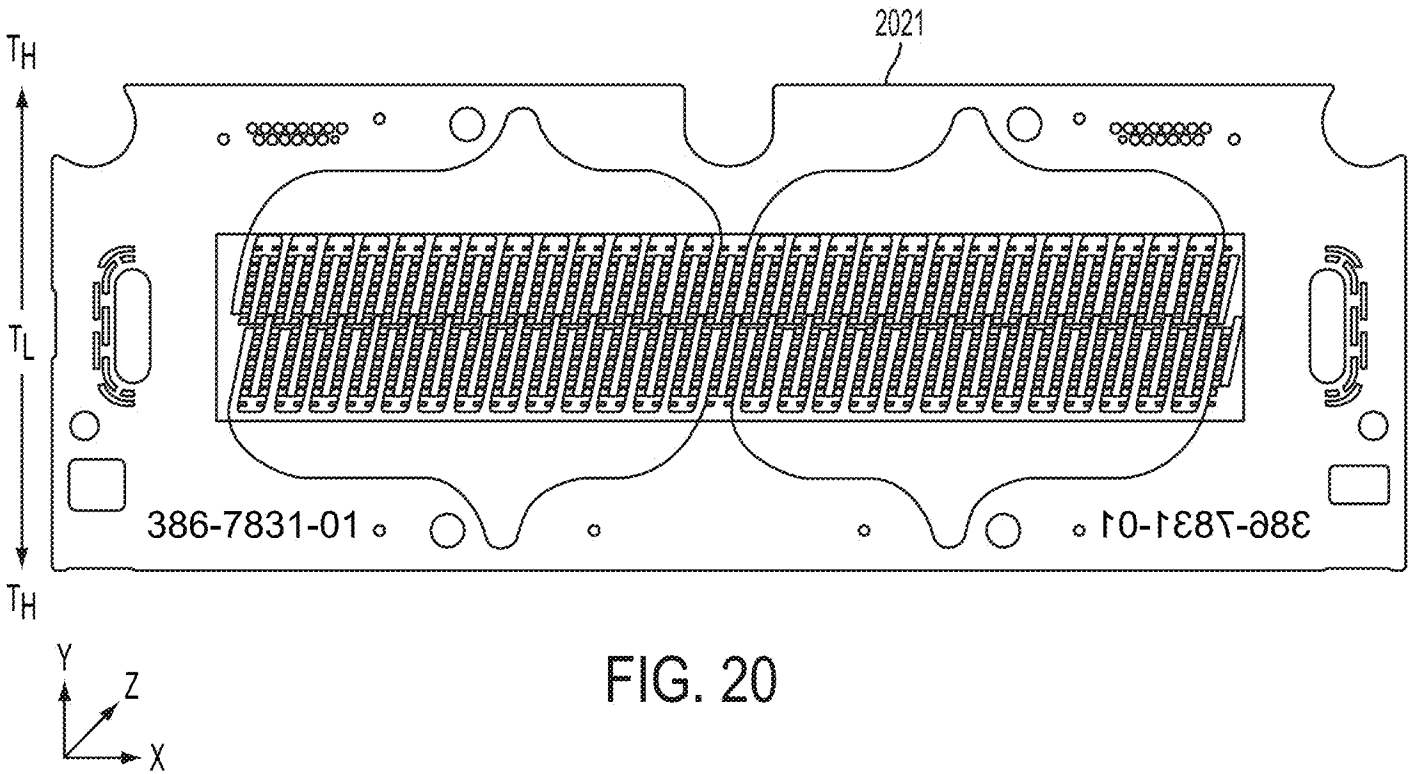
FIG. 20 shows thermal gradients that may be created in a jet stack to reduce voids and bubbles in the ink.

Examples that illustrate the use of thermal gradients for void/bubble reduction have been discussed herein with regard to creation of a thermal gradient between the reservoir and print head. Thermal gradients within the print head or jet stack may additionally or alternatively be implemented for void/bubble reduction. For example, with reference to FIG. 20, one or more thermal gradients may be created within the jet stack 2021 of a print head. For example, the thermal gradients may include higher temperatures, $T_H$, towards the edges of the jet stack and lower temperatures, $T_L$, toward the jet stack center, where the ink jets orifices and vents are located. For certain print head designs, it may also be possible to create thermal gradient along the z direction of the jet stack. However, the jet stack designs of many print heads are thin in the z direction and the ink flow path is primarily in the y direction. The thermal gradients may be created, for example, using active heating or cooling elements, by using separate passive thermal elements in different portions of the jet stack, e.g., heat sinks and/or insulators.

Figure 21:
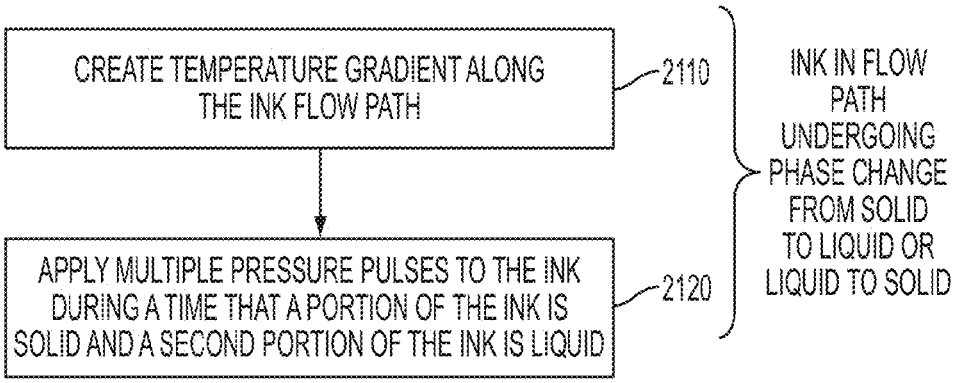
FIG. 21 is a flow diagram illustrating a process for reducing voids and bubbles in ink involving the application of multiple pressure pulses when a thermal gradient is present along the ink flow path, the thermal gradient causing one portion of the ink to be in solid phase and another portion of the ink to be in liquid phase.

Pulsed pressure may be applied to the ink flow path during the time that the ink is changing phase. Pulsed pressure may serve several purposes, including helping to dislodge stuck bubbles and/or particles, serving to more effectively force liquid ink in to voids, and/or enhancing movement of air through microchannels in the ink. FIG. 21 is a flow diagram that illustrates a process that includes application of multiple pressure pulses to the ink flow path during a time that the ink is changing phase. A thermal gradient can be created 2110 in the ink by heating and/or cooling regions of the ink path. The thermal gradient causes a first portion of ink in a first region of the ink flow path to be frozen, and a second portion of ink in a second region of the ink flow path to be liquid. For example, during the phase change of the ink, the ink in regions near the ink jets and vents in the print head may remain frozen while ink in the reservoir above the melting temperature of the ink. During the time that the ink is changing phase, while some of the ink is solid and some is liquid, a number of pressure pulses are applied 2120 to the ink. The pressure pulses are applied at a location along the ink flow path that facilitates moving liquid ink in the direction of the solid ink.

Figure 22:
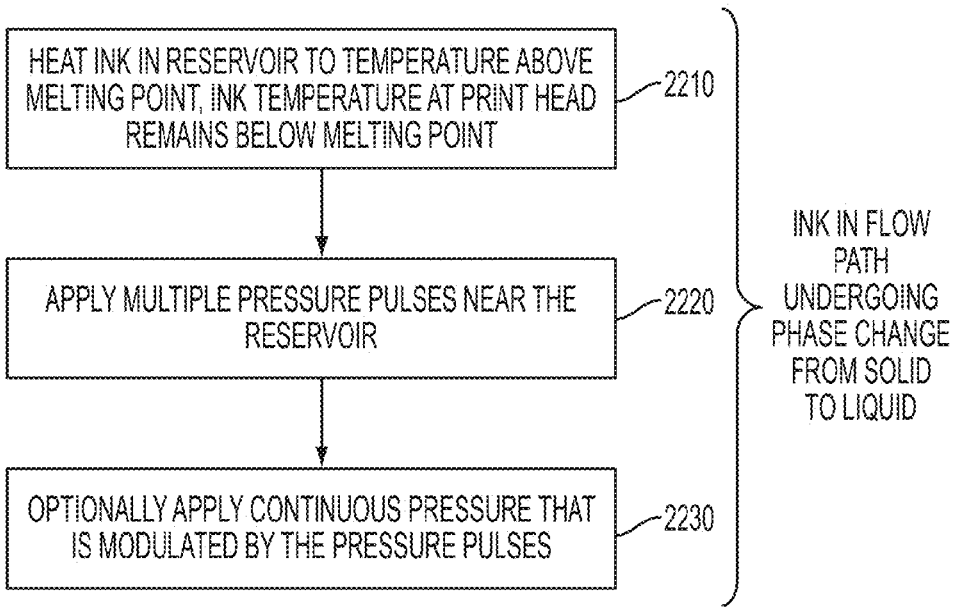
FIG. 22 is a flow diagram illustrating a process for reduction of voids and bubbles in the ink by applying multiple pressure pulses during a time that the ink is transitioning from a solid phase to a liquid phase.
Figure 23:
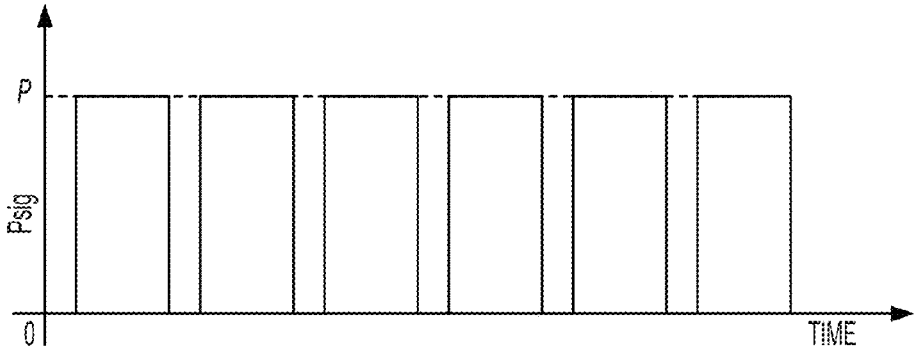
FIGS. 23-25 illustrate various patterns of pressure pulses that can be applied to ink in the ink flow path.

FIG. 22 is a more detailed flow diagram of a process of applying multiple pressure pulses to ink during a time that the ink is changing phase from a solid to a liquid, e.g., during a power up sequence of the printer. The pressure pulses are applied to remove air pockets from the ink that would become air bubbles if not purged from the system. A thermal gradient is created 2210 along the ink flow channel by activating a heater positioned near the reservoir. Ink in the reservoir is heated to a temperature that melts the ink in the reservoir and keeps the ink in the print head frozen. While the ink is changing phase, and the ink in the reservoir is liquid and the ink in the print head is liquid, multiple pressure pulses are applied 2220 to the ink flow path near the reservoir where the ink is liquid. Optionally, a continuous pressure can be applied 2230 in addition to the pulses so that the pulses modulate the continuous pressure. The use of a thermal gradient and pressure pulses during the power up sequence forces the air pockets out of the system before the ink completely melts, thus reducing the amount of bubbles in the liquid ink.

The multiple pressure pulses can be applied in various patterns, as illustrated by the graphs of FIGS. 23-28 depicting idealized pressure pulses as step functions. In should be appreciated that the actual pressure on the ink will not be a step function, however, the graphs of FIGS. 23-28 serve to demonstrate various possible characteristics of the pressure pulses. The pressure pulses need not be applied abruptly as implied by the step functions depicted in FIGS. 23-28, but may be applied in a ramp, sawtooth, triangle, or other wave shape.

FIG. 22 shows pressure pulses that vary the pressure applied to the ink from about 0 PSIG to a pressure, P, where P may be have a range of about 3 PSIG to about 8 PSIG, or a range of about 3.5 PSIG to about 6 PSIG. In some implementations, the pressure of the pressure pulses is about 4 PSIG. The pressure pulses may vary the pressure applied to the ink from about 0 PSIG to the maximum positive pressure of the pulse. In some cases, the pulses may vary the pressure from a slightly negative pressure to the maximum positive pressure.

The duty cycle of the pressure pulses may range from about 50 percent to about 85 percent, or about 60 percent to about 80 percent. In some implementations, the duty cycle of the pressure pulses may be constant and about 75 percent. The width of the pulses may range from about 100 ms to about 500 ms. In some implementations, the width of the pulses may be about 300 ms.

Figure 24:
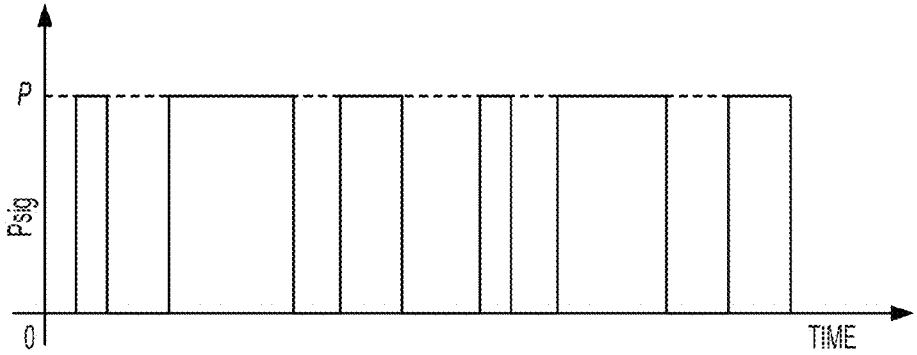

In some cases, the duty cycle and/or frequency of the pressure pulses may vary. The variation in duty cycle, width, and/or frequency may have a regular pattern or may be random. FIG. 24 illustrates random variation in pressure pulses which vary from 0 PSIG to a maximum pressure, P.

Figure 25:
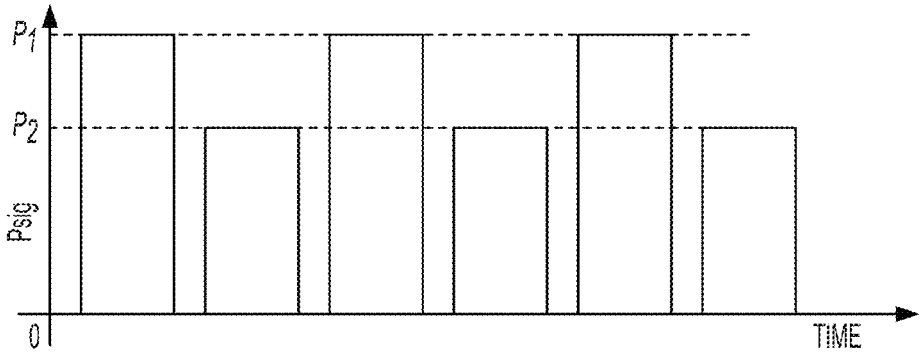

In some cases, the amplitude of the pressure pulses may vary. The variation in the amplitude may have a regular pattern or may be random. FIG. 25 depicts pressure pulses having a regular pattern of amplitude variation. As illustrated in FIG. 25, first pressure pulses vary the pressure from 0 to $P_1$. The first pressure pulses alternate with second pressure pulses that vary the pressure from 0 to $P_2$.

Figure 26:
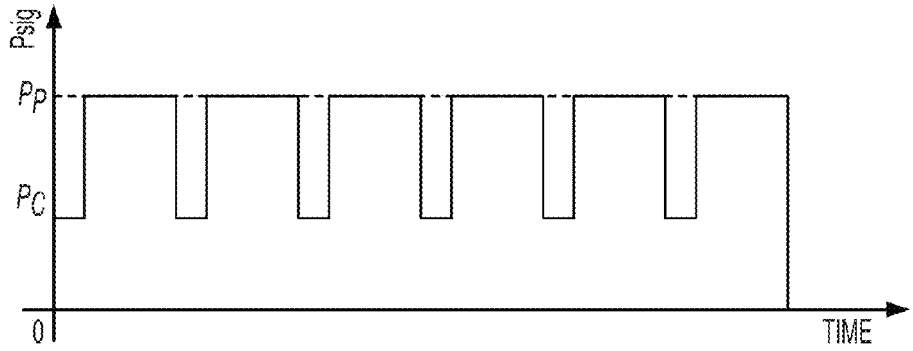
FIGS. 26-28 illustrate various patterns of continuous pressure modulated by pressure pulses that can be applied to ink in the ink flow path.
Figure 27:
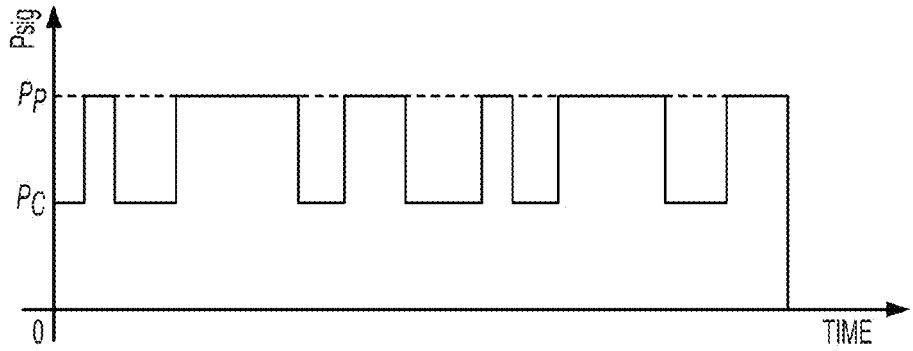
Figure 28:
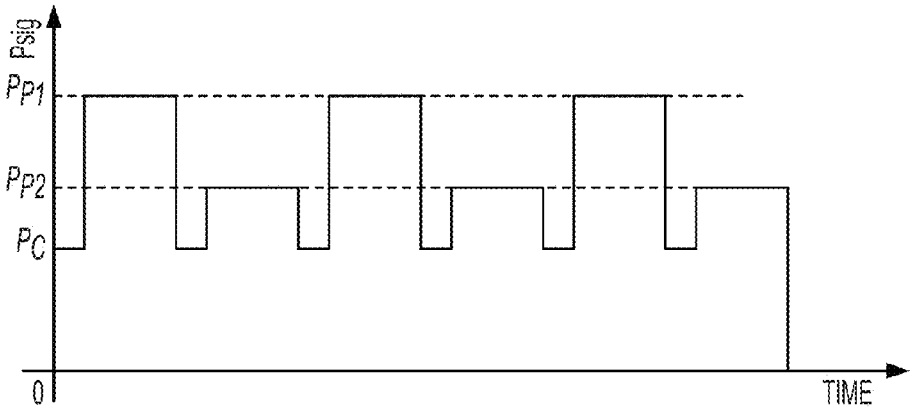

In some configurations, the pressure pulses are applied in conjunction with a constant pressure so that the pulses modulate the constant pressure, as depicted in FIGS. 26-28. FIG. 26 depicts a scenario in which the constant pressure, PC, is modulated by a pulse pressure $P_P$. The constant pressure may be in a range of about 3 to 6 PSIG and the modulating pulse pressure may be about 4 to 8 PSIG, for example. As shown in FIG. 26, the modulating pulses may have a constant duty cycle, e.g., a duty cycle of about 75%. Alternatively, the duty cycle, frequency and/or width of the modulating pulses may vary, either in a regular pattern or randomly, as shown in FIG. 27. The amplitude of the modulating pulses may also vary in a regular pattern, or may vary randomly. FIG. 28 illustrates the scenario in which the modulating pulses vary in a regular pattern, alternating between a first pressure, $P_{P1}$, and a second pressure, $P_{P2}$. Various other scenarios for pressure pulses used with or without a constant pressure and FIGS. 23-28 illustrate only a few of the possibilities.

Figure 29:
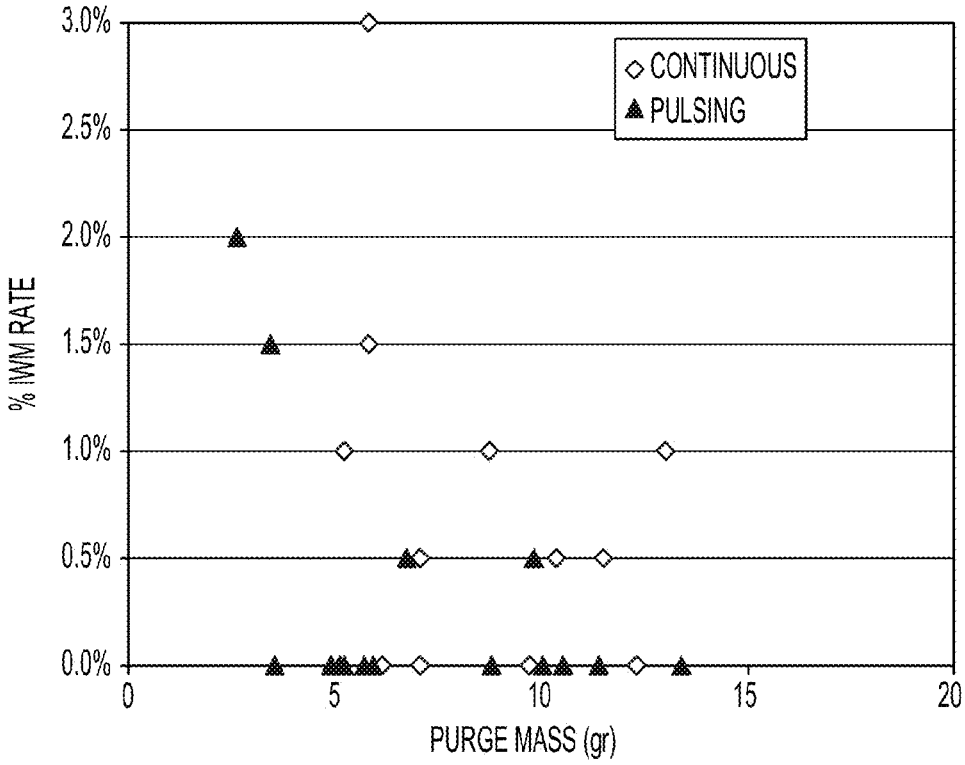
FIG. 29 compares print quality results achieved by applying a continuous pressure to ink in the ink flow path with print quality results achieved by applying a pulsed pressure to ink in the ink flow path.

Effectiveness of pulsed pressure at reducing bubbles was compared to the effectiveness of constant pressure. The rate of intermittent, weak, or missing (IWM) printing events was determined as a function of purge mass. It is desirable to achieve both low purge mass and low IWM rate. FIG. 29 shows the result of a test that compared the effectiveness of a constant pressure bubble mitigation to a pulsed pressure bubble mitigation. Both constant and pulsed pressure bubble mitigation operations were performed during a time that a thermal gradient was maintained along the ink flow path causing ink at the reservoir to be liquid, while ink at the print head remained frozen.

For the constant pressure bubble mitigation test, a constant pressure of 4 psig was applied to the ink flow path at location where the ink was liquid. The time of the constant pressure was varied from 1.5 sec to 4.5 sec to achieve the desired purge mass. After each of the constant pressure bubble mitigation operations, the rate of IWM events was determined. For the pulsed pressure bubble mitigation operation, pressure pulses that varied the pressure on the ink from about 0 PSIG to about 4 PSIG were applied. The pulses had a width of 300 ms and a duty cycle of 75%. The number of pulses applied varied from about 3 to about 15 to achieve the desired purge mass. After each of the pulsed pressure bubble mitigation operations, the rate of IWM events was determined. As can be appreciated from reviewing the data provided in FIG. 29, pulsed pressure bubble mitigation operation requires a lower purge mass to achieve a desired IWM rate.

Some embodiments involve a print head assembly designed and configured to achieve a certain ratio, denoted the critical Niyama value, $N_{yCR}$, between the thermal gradient and the cooling rate along the ink flow path. The Niyama number for an ink flow path may be expressed as:

$$N_y = \frac{G}{\sqrt{R}} \quad [1]$$

where G is the thermal gradient in C/mm and R is the cooling rate in C/s.

In embodiments described herein, the differences in thermal mass along the ink flow path may be configured to reduce the creation of voids and/or bubbles during phase transitions of the ink. In some cases the design may involve the concepts of "risering" or "feeding" using a relative large volume of ink, e.g., ink in the print head ink reservoir. The reservoir ink has substantial thermal mass and can be used to establish a thermal gradient in the ink flow path. Additionally, the reservoir ink can provide a positive pressure head to allow the ink to back fill into voids and microchannels in the ink. In some cases, active pressure assist beyond the hydrostatic pressure provided by the reservoir ink may also be implemented. Active thermal control using multiple active thermal elements may also be used to create the thermal gradient.

Figure 30:
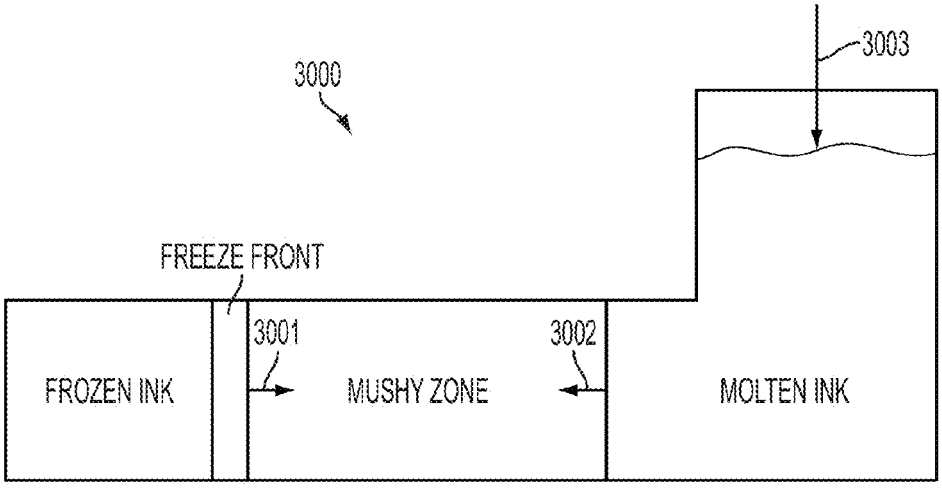
FIG. 30 diagrammatically illustrates the process of freezing ink along an ink flow path.

The diagram of FIG. 30 illustrates the process of freezing ink along an ink flow path. When ink, which contains a mixture of components, is freezing along an ink flow path 3000, there is typically a mushy zone that spans some temperature range between fully molten and fully solid ink in which only some of the mixture components are frozen. Molten ink that is pushed into the mushy zone the ink is solidifying and shrinking. The cooling rate of the ink dictates the speed of the freeze front, indicated by arrow 3001, and correspondingly the velocity at which molten the ink flows into the mushy zone, indicated by arrow 3002. Faster cooling rates mean that the flow into the solidifying region also increases, which requires a larger pressure gradient, which can be achieved by applied pressure indicated by arrow 3003. The thermal gradient from one end of the ink flow path to the other dictates the length of the mushy zone and the length over which molten ink must flow to reach the shrinking solidifying region of ink. Shallow thermal gradients can increase the mushy zone and can increase the amount of pressure 3003 required to flow molten ink into the mushy shrinkage region. Shallow thermal gradients can also reduce the amount of directionality of the freeze, leaving small pockets of unfrozen liquid. When the pockets of unfrozen liquid freeze, they shrink leaving voids in the frozen ink which entrain air.

To reduce voids, the ink flow path should have enough pressure to backfill the ink at the solid end of the mushy zone near the freeze front. If the pressure is not sufficient, molten ink cannot penetrate into the solidifying region and shrinkage, voids, and air entrapment will result. The required amount of pressure to backfill the ink can be expressed as:

$$P_{CR} = \frac{1}{N_y^2}\frac{\mu\beta\Delta T}{d^2}\left(\frac{360\phi_{CR}\ln(\phi_{CR}) - 180\phi_{CR}^2 + 180}{\phi_{CR}}\right) \quad [2]$$

where $N_y$ is the Niyama number, $\mu$ is the melt viscosity, $\beta$ is related to the amount of shrinkage, $\Delta T$ is the temperature range of the mushy zone, d is the characteristic crystal size in the mushy zone, and $\phi_{CR}$ is related to the point in the mush at which ink is effectively solid and pressure for backfill is no longer effective.

The Niyama number may be calculated at a "critical temperature," e.g., at some fraction of the mushy zone temperature range. For a given amount of feeding pressure, there the critical Niyama value (ratio of thermal gradient to cooling rate) achieves minimal porosity or bubbles. The critical Niyama value is material dependent Ink flow paths having a low value of the critical Niyama value are desirable since this means that relatively small gradients or large cooling rates along the ink flow path can be employed to achieve void/bubble reduction which are amenable to simple engineering controls.

Figure 31:
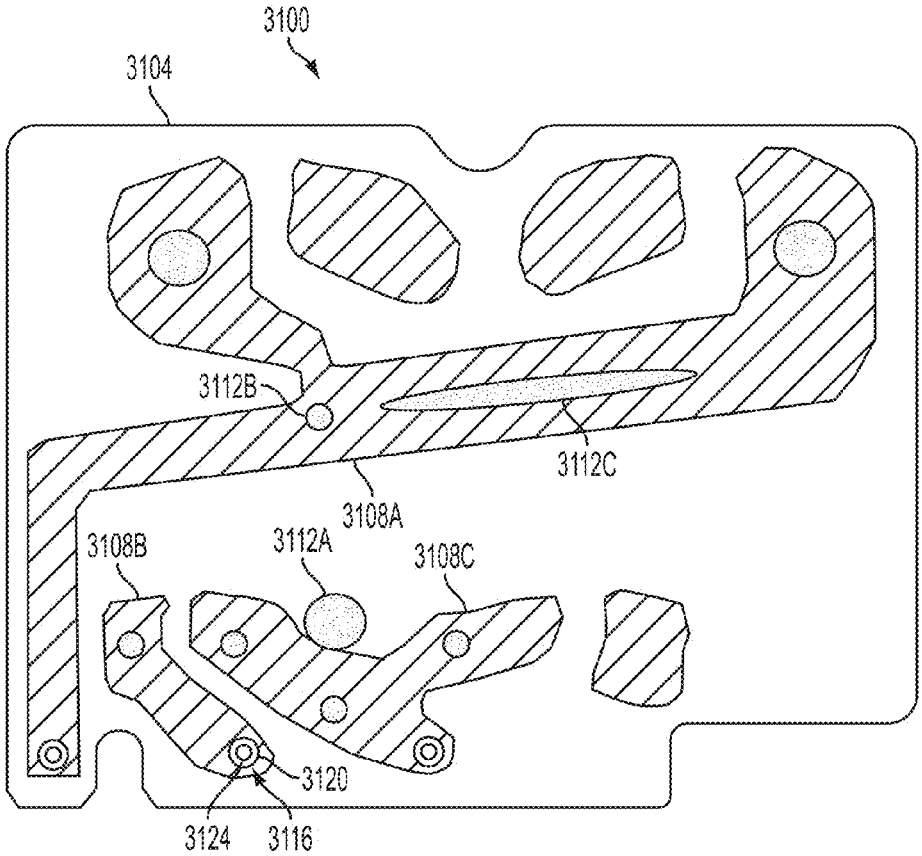
FIG. 31 is a cross sectional view of a print head assembly showing various thermal elements that may be employed to achieve a predetermined Niyama number for an ink flow path.

Print head assemblies may be designed and configured with thermal elements that achieve ink flow paths having Niyama numbers that are greater than the critical Niyama value, i.e., ratio of cooling rate of the ink to thermal gradient along the ink flow path, that provides optimal void/bubble reduction. An example of a print head assembly designed to achieve a predetermined Niyama number is depicted in the cross-sectional view of FIG. 31. The portion of the print head assembly 3100 has a housing 3104, typically made of a metal, such as stainless steel or aluminum or a polymer material. Within the housing 3104 are one or more chambers that hold ink as exemplified by chambers 3108A, 3108B, and 3108C. These chambers may be in fluid communication with one another through a passage not visible at the location of the cross-section. The chambers may have various shapes and sizes as determined by the requirements for ink flow through the print head assembly 3100. In the print head assembly 3100 of FIG. 31, various thermal elements 3112A-C are disposed within and about the chambers 3108A-C.

Some or all of the thermal elements 3112 may pass through housing 3104 and connect to the exterior of the housing 3104. The thermal elements 3112 act to control the temperature of the ink, e.g. by thermally passive or active means. For example, the thermal elements 3112 may be active heaters of coolers capable of actively supplying thermal energy to the ink. In some cases, the thermal elements 3112 may be passive elements, such as heatsinks comprising a thermally conductive material, that are used to control the rate of heat transfer from ink disposed within each chamber 3108 to the exterior of housing 3104. As used herein, thermal conductor refers to a material having a relatively high coefficient of thermal conductivity, k, which enables heat to flow through the material across a temperature differential. Heat sinks are typically metallic plates that may optionally have metallic fins that aid in radiating conducted heat away from print head assembly 3100. The thermal elements 3112 can be positioned so that the various regions of each chamber 3108 have an approximately equal thermal mass. The thermal elements 3112 may be placed proximate to the ink flow path or placed within the ink flow. For example, thermal elements may be disposed within the ink reservoir.

In designing the print head assembly, the type (active or passive), size, properties, and/or location of the thermal elements can be taken into account to achieve optimal void/bubble reduction. If passive thermal elements are deployed, the particular material of the thermal element may be selected considering the desired thermal conductivity for each thermal conductor. Different print heads may use differing materials with differing thermal conductivities. Similarly, where one print head assembly may use a passive thermal element, another print head assembly may use an active one.

The thermal elements can be placed and/or controlled in a manner that produces the desired Niyama number for the ink flow path in the print head assembly. Active or passive thermal elements may be deployed along the ink flow path and may be controlled to achieve a desired ratio between cooling rate and thermal gradient, the critical Niyama value. In some configurations, a print head assembly may additionally use passive thermal elements appropriately deployed to reduce the differences in thermal mass along the ink flow path. Reducing the difference in the thermal mass facilitates reducing differences in the Niyama number along the ink flow path. In some cases, the Niyama number may be maintained along the ink flow path to be above the critical Niyama value. From a design standpoint, there may be some uncertainty in the critical Niyama value for any given ink flow path. Thus, if the value of the critical Niyama value is known to +/−X %, e.g., +/−10%, then good design practice would indicate designing ink flow path having a Niyama number that is X % above the critical Niyama value.

FIGS. 5-10 illustrate various print head assemblies 500-1000 that can be designed to achieve a predetermined ratio of thermal gradient to cooling rate. For example, returning to the print head assembly 500 of FIG. 5 as an example, the assembly 500 can be designed to include controlled active heating in the ink reservoir to provide the thermal gradient. A controlled, active pressure source as illustrated in FIG. 5 and/or orientation of the ink flow path as illustrated in FIGS. 9 and/or 10 may be used to achieve the appropriate backfill pressure for the thermal gradient/cooling rate ratio to provide optimal void/bubble reduction.

In some embodiments, the print head may include insulation elements (543, FIG. 5) at various locations around the print head assembly 500 to minimize cooling rate and/or to modulate heat loss in certain areas to achieve an appropriate value of the Niyama number. The print head assembly 500 may include controlled active heating or cooling of the ink flow path, e.g., heaters/coolers at the print head 520 and reservoir 510, that can be controlled to achieve the Niyama number. Geometric configuration or heat transfer features of the print head assembly may be designed to minimize differences in the Niyama number along the ink flow path. several zones of the ink flow path may be controlled so that the thermal gradient/cooling rate ratio remains above the predetermined Niyama number for the phase change ink of interest.

Figure 32:
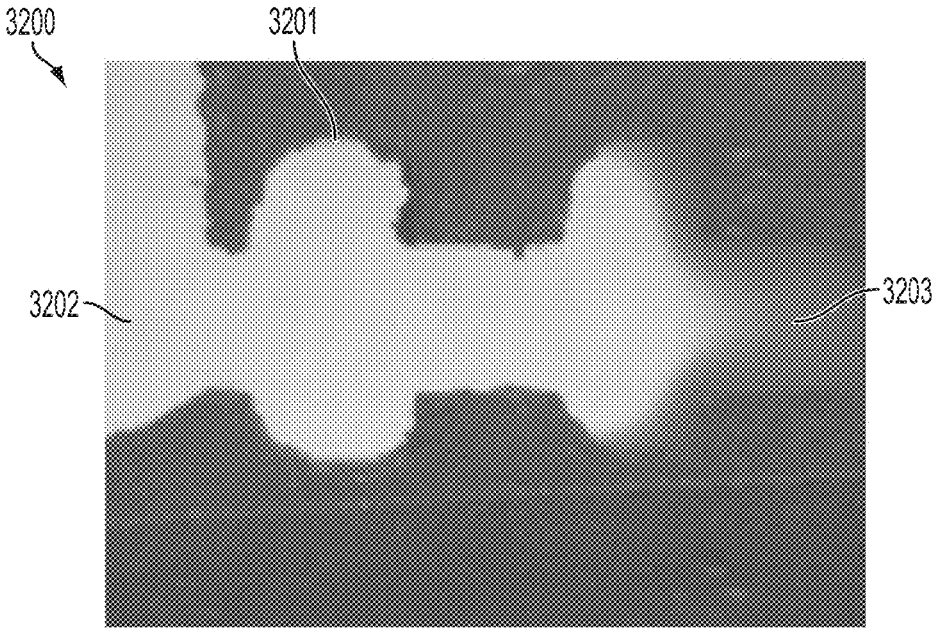
FIGS. 32-37 illustrate an experimental structure containing ink at various times as the ink is transitioning from liquid to solid phase.
Figure 33:
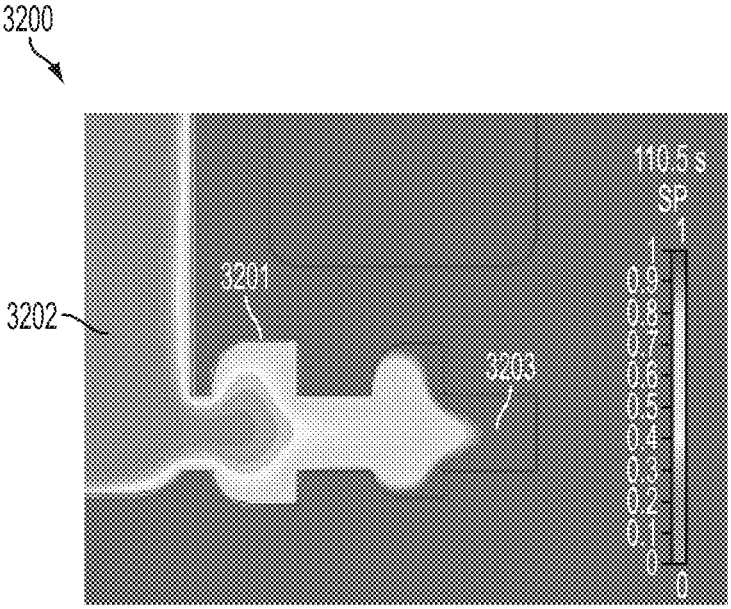
Figure 34:
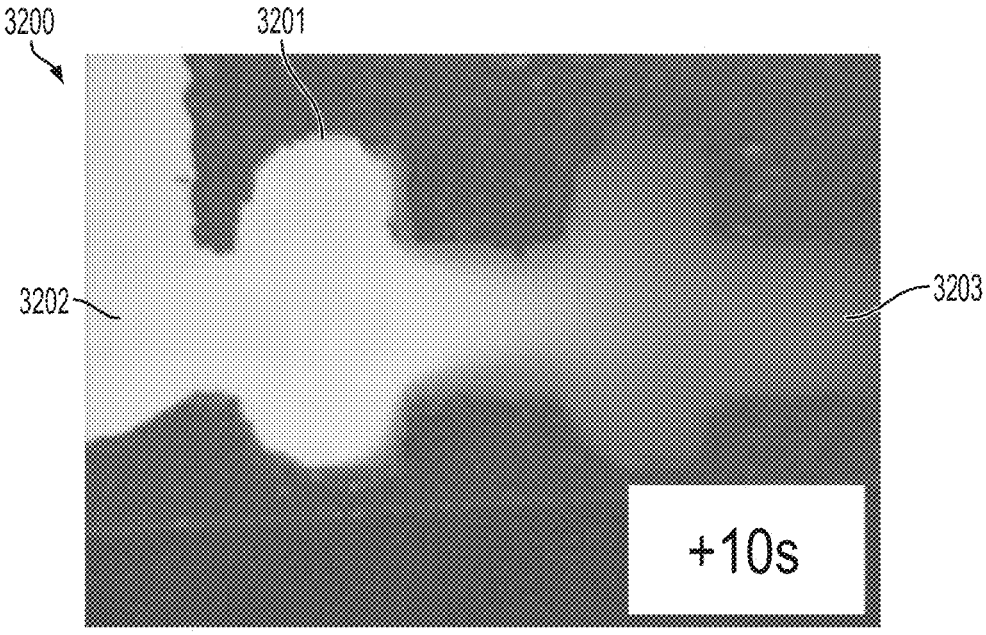
Figure 35:
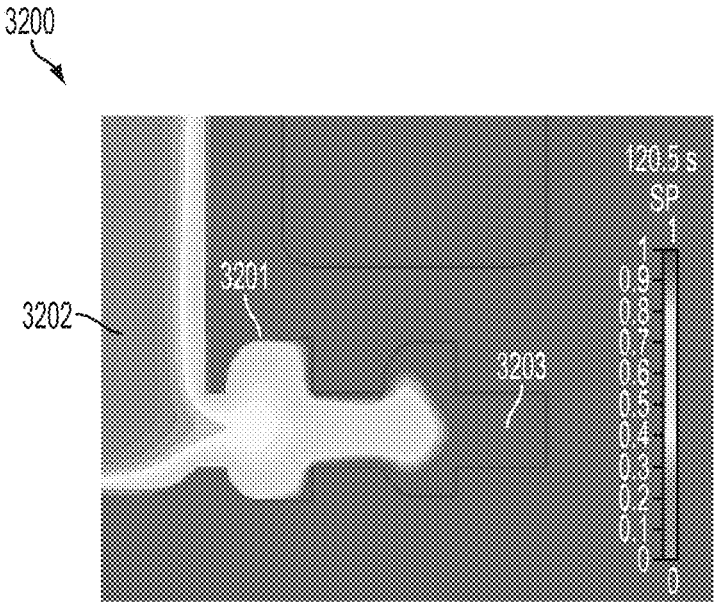
Figure 36:
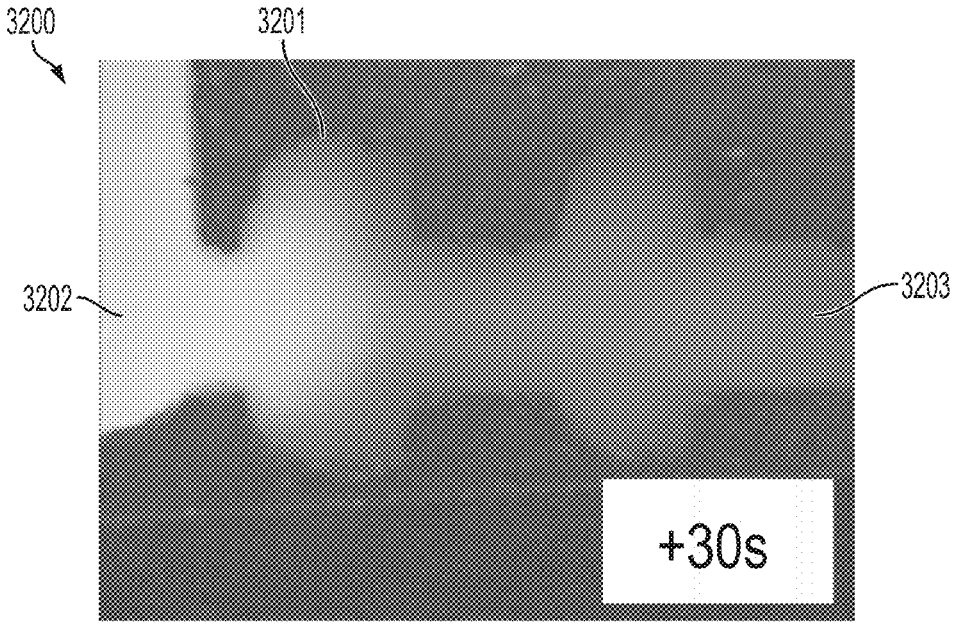
Figure 37:
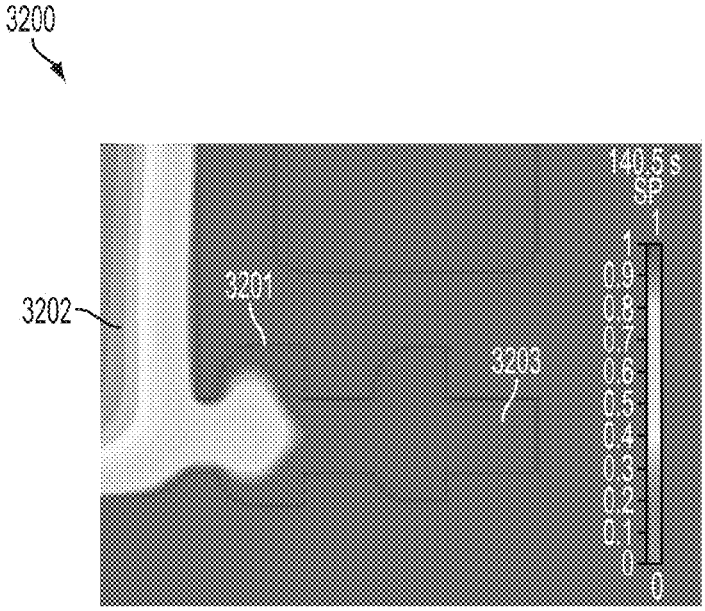
Figure 38:
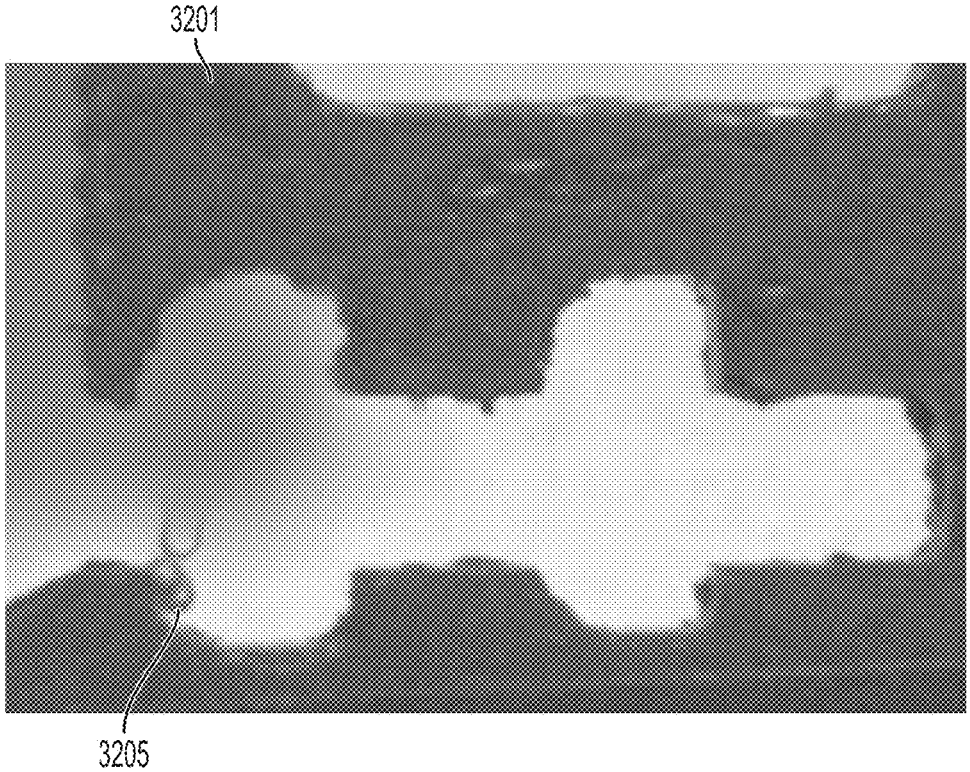
FIG. 38 is a photograph showing bubbles formed in the ink in flare regions of the experimental structure.

To demonstrate the effectiveness of print head assembly design based on Niyama number, an experimental structure including features having geometry similar to portions of a print head assembly was constructed. As depicted in FIGS. 32-37, the experimental structure 3200 includes several "flare" regions 3201. The flow path of the experimental structure had sufficiently small differences in thermal mass so that freezing pinch off of liquid ink volumes did not occur. The phase change ink was frozen in a directional manner as shown in FIGS. 32-37. FIGS. 32, 34, and 36 are photographs of the ink freezing in the experimental structure 1800 at times t, t+10 sec, and t+20 sec, respectively. The frozen ink 3203 appears gray in the photographs of FIGS. 32, 34, and 36 and the liquid ink 3202 appears white. FIGS. 33, 35, and 37 are images based on models that correspond, respectively, to the structures of FIGS. 32, 34, and 36. FIGS. 32 and 33 showing regions of frozen and liquid ink, 3203, 3202 in experimental structure 3200 during the ink freezing process at time t secs; FIGS. 34 and 35 show regions of frozen and liquid ink 3203, 3202 in experimental structure 3200 during the ink freezing process at time t+10 secs; FIGS. 36 and 37 show regions of frozen and liquid ink 3203, 3202 in experimental structure 3200 during the ink freezing process at time t+30 secs. The left side of the experimental structure 3200 was heated using resistive heating and the right side of the experimental structure 3200 was cooled using ethylene glycol. The progressive freeze produces illustrated by FIGS. 32-37 produces large mushy zone relative to the features of the experimental structure 3200.

Figure 39:
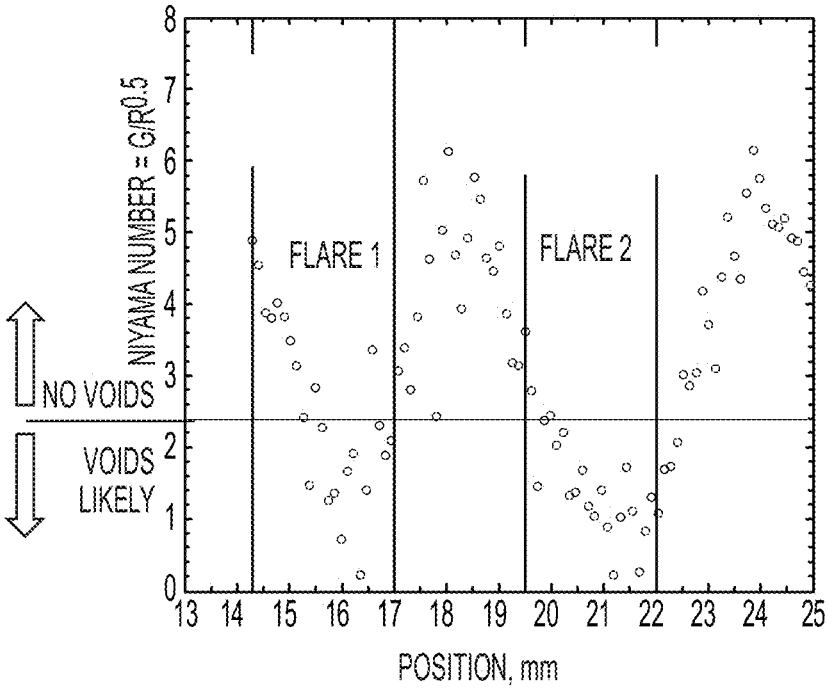
FIG. 39 is a graph of Niyama number vs. distance along the ink flow path of the experimental structure.
Figure 40:
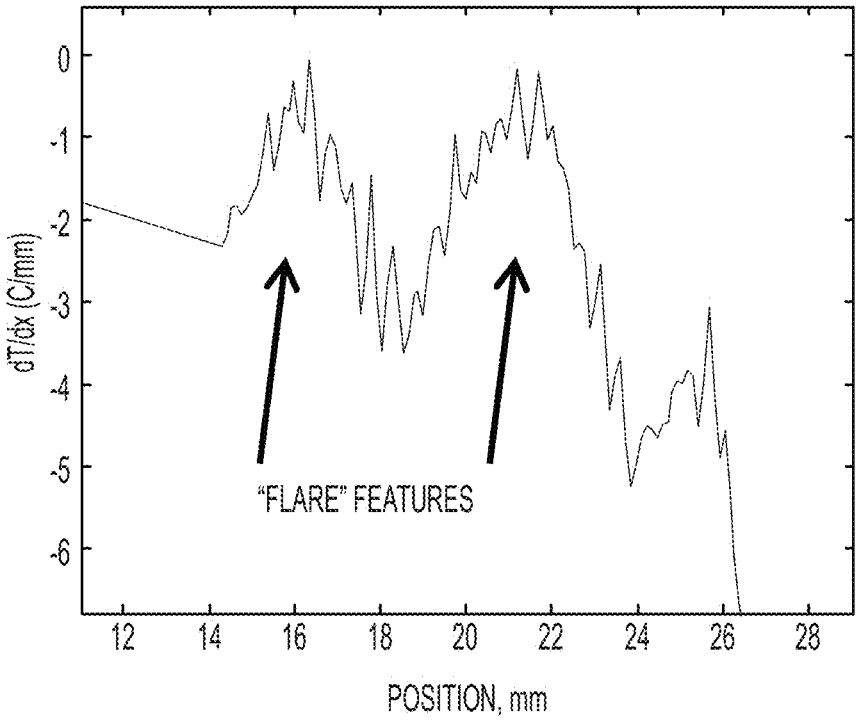
FIG. 40 is a graph of the thermal gradient vs. distance along the ink flow path of the experimental structure.
Figure 41:
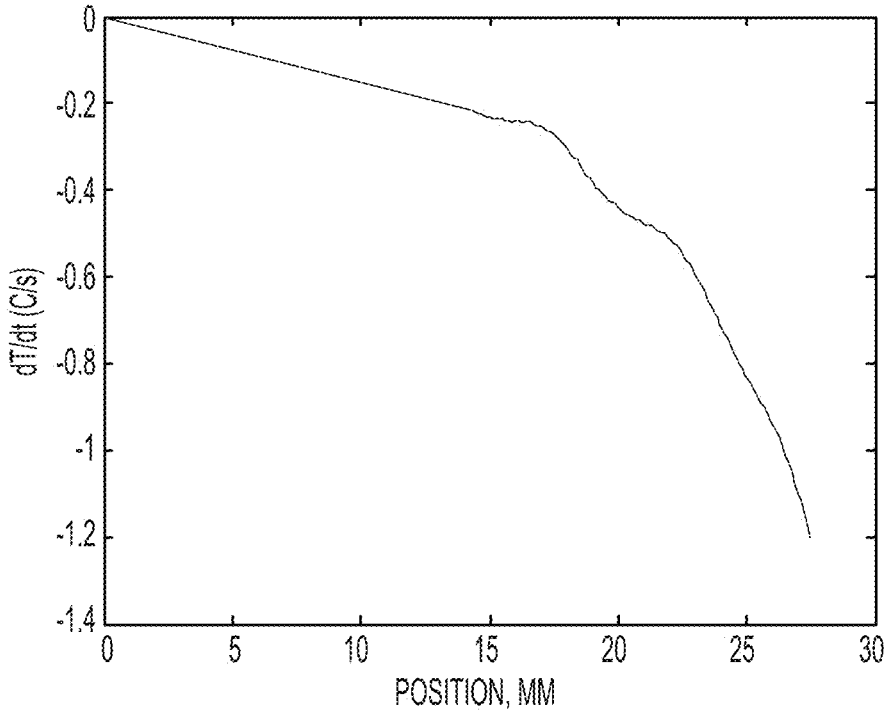
FIG. 41 is a graph of the cooling rate vs. distance along the ink flow path of the experimental structure.

As shown in FIG. 39, upon remelt, bubbles 3205 were repeatedly found in the flare regions 1801. The Niyama number of the experimental structure 3200 was determined using infrared photography (see FIG. 39), for a critical temperature $T_{crit}$ of 81.5 C and estimated pressure at the reservoir of 234 Pa. The graph of Niyama number vs. distance along the ink flow path of experimental structure 3200 provided in FIG. 39 illustrates that the flare regions have a Niyama number that is lower than the critical Niyama value (roughly 2.4) for the ink used in this experiment. Bubbles result from the inability to flow hot molten ink into the shrinkage regions of the flare regions 3201. The resulting shrinkage voids from bubbles due to microscopic cracks feeding air to the cavity or from ink cavitation or outgassing when certain inks are used. FIG. 40 illustrates the thermal gradient, dT/dx, along the ink flow path of the experimental structure. The thermal gradient is lower in the flare regions as shown in FIG. 40. FIG. 41 is a graph of the cooling rate along the ink flow path of the experimental structure.

Mitigation of the bubble formation for the experimental structure may be achieved, for example, by more thorough insulation of the faces to minimize heat loss, lowering the cooling rate and/or increasing the thermal gradient in the flare regions. Using localized heating or cooling as the freeze front approaches the flare regions would increase complexity, but may improve the thermal gradient. Modifying the shape of the fluidic path to minimize differences in surface area to volume ratio will also reduce the differences in the Niyama value. In this example, minimizing differences in surface area to volume ratio could involve reducing the size of the flares.

Various modifications and additions can be made to the embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. A print head assembly for an ink jet printer, comprising;
an ink flow path, the ink flow path configured to allow passage of a phase-change ink along the ink flow path;
a pressure unit configured apply pressure to the ink; and
a control unit configured to control the pressure applied to the ink and to coordinate the pressure applied to the ink with temperature of the ink during a time that the ink in the ink flow path is undergoing a phase change, wherein coordination of the pressure applied to the ink with the temperature of the ink is configured to push air out of a free surface of the ink flow path.

2. The print head assembly of claim 1, wherein the phase change involves a transition from a solid phase to a liquid phase.

3. The print head assembly of claim 1, wherein the phase change involves a transition from a liquid phase to a solid phase.

4. The print head assembly of claim 1, further comprising one or more thermal elements configured to heat or cool the ink.

5. The print head assembly of claim 4, wherein the thermal elements are active thermal elements controlled by the control system.

6. The print head assembly of claim 5, wherein the pressure unit is configured to apply a variable pressure to the ink.

7. The print head assembly of claim 4, wherein the control unit is configured to control the thermal elements to create a thermal gradient along at least a portion of the ink flow path during the time that the ink is undergoing the phase change, the thermal gradient causing one portion of the ink in the ink flow path to be in solid phase and a second portion of the ink in the ink flow path to be in liquid phase.

8. The print head assembly of claim 1, further comprising:

one or more temperature sensors positioned on components defining the ink flow path, the temperature sensors configured to generate electrical signals modulated by temperature of the ink; and the control unit is configured to receive the electrical signals and to control the pressure applied to the ink in response to the electrical signals.

9. A method of operating an ink jet printer, comprising;

applying pressure to ink in an ink flow path of the ink jet printer; and coordinating the pressure applied to the ink with temperature of the ink during a time that the ink in the ink flow path is undergoing a phase change; and forcing air out of the ink through a free surface of the ink flow path in response to coordinating the pressure applied to the ink with the temperature of the ink.

10. The method of claim 9, wherein the phase change involves a transition from a solid phase to a liquid phase.

11. The method of claim 9, wherein the phase change involves a transition from a liquid phase to a solid phase.

12. The method of claim 9, further comprising controlling the temperature of the ink.

13. The method of claim 9, wherein applying the pressure to the ink comprises applying a variable pressure to the ink.

14. The method of claim 9, further comprising controlling the temperature of the ink to create a thermal gradient along at least a portion of the ink flow path during the time that the ink is undergoing the phase change, the thermal gradient causing one portion of the ink in the ink flow path to be in solid phase and a second portion of the ink in the ink flow path to be in liquid phase.

15. An ink jet printer, comprising:

a print head assembly comprising:

a print head with ink jets configured to selectively eject ink toward a print medium according to predetermined pattern;

an ink flow path, the ink flow path configured to allow passage of a phase-change ink along the ink flow path to the ink jets;

a pressure unit configured apply pressure to the ink; and a control unit configured to control the pressure applied to the ink and to coordinate the pressure applied to the ink with temperature of the ink during a time that the ink in the ink flow path is undergoing a phase change, the coordination of the pressure applied to the ink with the temperature of the ink configured to push air out of a free surface of the ink flow path; and a transport mechanism configured to provide relative movement between the print medium and the print head.

16. The printer of claim 15, further comprising thermal elements configured to create a thermal gradient along at least a portion of the ink flow path during the time that the ink is undergoing the phase change, the thermal gradient causing one portion of the ink in the ink flow path to be in solid phase and a second portion of the ink in the ink flow path to be in liquid phase.

17. The printer of claim 16, further comprising one or more temperatures sensors configured to sense the temperature of the ink at one or more locations, wherein the control unit is configured to control the thermal elements to create the thermal gradient based on the sensed temperature of the ink.

18. A print head assembly for an ink jet printer, comprising:

one or more components that define an ink flow path of the ink jet printer, the ink flow path configured to allow passage of a phase-change ink along the ink flow path;

a pressure unit configured to apply pressure to the ink; and a control unit configured to coordinate the pressure applied to the ink with temperature of the ink during a time that the ink is transitioning form a liquid phase to a solid phase and a portion of the ink in the ink flow path is in a solid phase and another portion of the ink in the ink flow path is in a liquid phase, wherein coordination of the pressure applied to the ink with the temperature of the ink is configured to push air out of a free surface of the ink flow path.

19. The assembly of claim 18, further comprising one or more thermal elements, wherein the control unit is configured to control the thermal elements.

20. The assembly of claim 18, further comprising one or more temperature sensors configured to sense temperature of the ink, wherein the control unit is configured to coordinate the pressure with the sensed temperature of the ink.

21. The assembly of claim 18, further comprising one or more thermal elements, wherein the control is configured to control the thermal elements to create a temperature gradient along at least a portion of the ink flow path.

22. The assembly of claim 21, wherein the components include at least a reservoir and a print head and the temperature gradient includes a higher temperature at the reservoir and a lower temperature at the print head.

23. A method of reducing voids in the ink of an ink jet printer, comprising:

determining temperature of ink in an ink flow path of the ink jet printer during a time the ink is undergoing a transition from a liquid phase to a solid phase, wherein a portion of the ink in the ink flow path is in liquid phase and another portion of the ink in the ink flow path is in solid phase;

coordinating pressure applied to the ink with the temperature of the ink during the transition; and forcing air out of the ink through a free surface of the ink flow path in response to coordinating the pressure applied to the ink with the temperature of the ink.

24. The method of claim 23, wherein coordinating the pressure comprises coordinating a variable pressure as a function of the temperature.

25. The method of claim 23, further comprising controlling one or more thermal elements to create a thermal gradient in the ink during the transition.

26. The method of claim 25, further comprising coordinating the pressure with the thermal gradient.

27. An ink jet printer configured to implement the method of claim 25.

28. The method of claim 23, wherein the controlling the thermal elements comprises applying phased zoned heating to the ink flow path, the phased zone heating including:

heating a first zone of the ink flow path; and after heating the first zone, heating a second zone of the ink flow path.

29. An ink jet printer configured to implement the method of claim 23.

* * * * *